US006785482B2

(12) United States Patent
Ogata et al.

(10) Patent No.: US 6,785,482 B2
(45) Date of Patent: Aug. 31, 2004

(54) IMAGE FORMING APPARATUS HAVING A TRANSFER CURRENT DETECTION DEVICE AND CONTROL FOR DEVELOPING BIAS IN NON-IMAGE AREA

(75) Inventors: Hiroaki Ogata, Shizuoka (JP); Miyuki Oki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/368,611

(22) Filed: Feb. 20, 2003

(65) Prior Publication Data

US 2003/0175040 A1 Sep. 18, 2003

(30) Foreign Application Priority Data

Feb. 22, 2002 (JP) ..... 2002-046945
Feb. 22, 2002 (JP) ..... 2002-046946
Feb. 22, 2002 (JP) ..... 2002-046947
Feb. 22, 2002 (JP) ..... 2002-046948

(51) Int. Cl.[7] ..... G03G 15/06
(52) U.S. Cl. ..... 399/55
(58) Field of Search ..... 399/26, 45, 55, 399/66, 270, 285, 314

(56) References Cited

U.S. PATENT DOCUMENTS 5,887,220 A * 3/1999 Nagaoka ..... 399/46
5,966,561 A * 10/1999 Yamaguchi ..... 399/66
5,983,044 A * 11/1999 Kodama et al. ..... 399/49
6,070,025 A * 5/2000 Jeong ..... 399/66
6,639,617 B2 * 10/2003 Yokogawa ..... 347/130
2002/0106210 A1 8/2002 Oki ..... 399/66

FOREIGN PATENT DOCUMENTS

JP 6-175514 6/1994
JP 06194901 A * 7/1994 ..... G03G/15/00
JP 2000-293019 10/2000
JP 2001100469 A * 4/2001 ..... G03G/15/00

* cited by examiner

*Primary Examiner*—Robert Beatty
(74) *Attorney, Agent, or Firm*—Fitzpatrick, Cella, Harper & Scinto

(57) ABSTRACT

An image forming apparatus, includes an image bearing device for bearing an image to be formed on a transferring material; a charger; an exposing device; a developing device; a transferring device, which transfers a developed image formed on the image bearing device to a transferring material; a current detector, which detects a transferring current flowing through the transferring device; and a controller. A voltage set in the developing device for an image forming area of the image bearing device is different from a voltage set in the developing device for the non-image-forming area of the image bearing device. The controller controls the voltage set in the developing portion, wherein a voltage for the non-image-forming area is controlled based on an output of the current detector.

22 Claims, 17 Drawing Sheets

| TRANSFERRING CURRENT VALUE Ia | DEVELOPING BIAS CONTROL VALUE V |
|---|---|
| 10 μA TO | −350V |
| 30 μA TO | −360V |
| 50 μA TO | −370V |
| 70 μA TO | −380V |
| 90 μA TO | −390V |
| 110 μA TO | −400V |

| TRANSFERRING CURRENT VALUE Ia | DEVELOPING BIAS CONTROL VALUE | | |
|---|---|---|---|
| | THICKNESS OF CT LAYER = 10 μm | THICKNESS OF CT LAYER = 12 μm | THICKNESS OF CT LAYER = 15 μm |
| 10 μA TO | −355V | −335V | −310V |
| 30 μA TO | −370V | −350V | −325V |
| 50 μA TO | −380V | −365V | −340V |
| 70 μA TO | −390V | −375V | −350V |
| 90 μA TO | −400V | −385V | −360V |
| 110 μA TO | −410V | −395V | −370V |

FIG. 17

| TRANSFERRING CURRENT VALUE Ia | STANDARD SHEET | | HEAVY SHEET | GLOSSY SHEET | | OHT SHEET |
|---|---|---|---|---|---|---|
| | FIRST PAGE | WHEN BOTH FACES PRINT SECOND PAGE | FIRST PAGE | FIRST PAGE | WHEN BOTH FACES PRINT SECOND PAGE | FIRST PAGE |
| 10 μA TO | 1600V | 2000V | 1800V | 1400V | 1800V | 2000V |
| 30 μA TO | 1400V | 1800V | 1600V | 1200V | 1600V | 1900V |
| 50 μA TO | 1200V | 1600V | 1400V | 1000V | 1400V | 1800V |
| 70 μA TO | 1000V | 1400V | 1200V | 800V | 1200V | 1700V |
| 90 μA TO | 800V | 1200V | 1000V | 600V | 1000V | 1600V |
| 110 μA TO | 600V | 1000V | 800V | 600V | 800V | 1500V |

FIG. 18

| TRANSFERRING CURRENT VALUE Ia | DEVELOPING BIAS CONTROL VALUE V |
|---|---|
| 10 μA TO | −320V |
| 30 μA TO | −330V |
| 50 μA TO | −340V |
| 70 μA TO | −350V |
| 90 μA TO | −360V |
| 110 μA TO | −370V |

FIG. 19

TRANSFERRING BIAS TABLE (DETECTION CURRENT Ia VERSUS TRANSFERRING BIAS CONTROL VALUE FOR EACH OF TRANSFERRING MATERIALS AND PRINT MODE)

FIRST COLOR

| DETECTION CURRENT Ia | STANDARD SHEET | | HEAVY SHEET | GLOSSY SHEET | | OHT SHEET |
|---|---|---|---|---|---|---|
| | FIRST PAGE | WHEN BOTH FACES PRINT SECOND PAGE | FIRST PAGE | FIRST PAGE | WHEN BOTH FACES PRINT SECOND PAGE | FIRST PAGE |
| 10μA TO | 1600V | 2000V | 1800V | 1400V | 1800V | 2000V |
| 30μA TO | 1400V | 1800V | 1600V | 1200V | 1600V | 1900V |
| 50μA TO | 1200V | 1600V | 1400V | 1000V | 1400V | 1800V |
| 70μA TO | 1000V | 1400V | 1200V | 800V | 1200V | 1700V |
| 90μA TO | 800V | 1200V | 1000V | 600V | 1000V | 1600V |
| 110μA TO | 600V | 1000V | 800V | 600V | 800V | 1500V |

SECOND COLOR

| DETECTION CURRENT Ia | STANDARD SHEET | | HEAVY SHEET | GLOSSY SHEET | | OHT SHEET |
|---|---|---|---|---|---|---|
| | FIRST PAGE | WHEN BOTH FACES PRINT SECOND PAGE | FIRST PAGE | FIRST PAGE | WHEN BOTH FACES PRINT SECOND PAGE | FIRST PAGE |
| 10μA TO | 1600V | 2100V | 1850V | 1400V | 1800V | 2200V |
| 30μA TO | 1400V | 1900V | 1650V | 1200V | 1600V | 2100V |
| 50μA TO | 1200V | 1700V | 1450V | 1000V | 1400V | 2000V |
| 70μA TO | 1000V | 1500V | 1250V | 800V | 1200V | 1900V |
| 90μA TO | 800V | 1300V | 1050V | 600V | 1000V | 1800V |
| 110μA TO | 600V | 1100V | 850V | 600V | 800V | 1700V |

THIRD COLOR

| DETECTION CURRENT Ia | STANDARD SHEET | | HEAVY SHEET | GLOSSY SHEET | | OHT SHEET |
|---|---|---|---|---|---|---|
| | FIRST PAGE | WHEN BOTH FACES PRINT SECOND PAGE | FIRST PAGE | FIRST PAGE | WHEN BOTH FACES PRINT SECOND PAGE | FIRST PAGE |
| 10μA TO | 1600V | 2200V | 1900V | 1400V | 1800V | 2400V |
| 30μA TO | 1400V | 2000V | 1700V | 1200V | 1600V | 2300V |
| 50μA TO | 1200V | 1800V | 1500V | 1000V | 1400V | 2200V |
| 70μA TO | 1000V | 1600V | 1300V | 800V | 1200V | 2100V |
| 90μA TO | 800V | 1400V | 1100V | 600V | 1000V | 2000V |
| 110μA TO | 600V | 1200V | 900V | 600V | 800V | 1900V |

FOURTH COLOR

| DETECTION CURRENT Ia | STANDARD SHEET | | HEAVY SHEET | GLOSSY SHEET | | OHT SHEET |
|---|---|---|---|---|---|---|
| | FIRST PAGE | WHEN BOTH FACES PRINT SECOND PAGE | FIRST PAGE | FIRST PAGE | WHEN BOTH FACES PRINT SECOND PAGE | FIRST PAGE |
| 10μA TO | 1600V | 2300V | 1950V | 1400V | 1800V | 2600V |
| 30μA TO | 1400V | 2100V | 1750V | 1200V | 1600V | 2500V |
| 50μA TO | 1200V | 1900V | 1550V | 1000V | 1400V | 2400V |
| 70μA TO | 1000V | 1700V | 1350V | 800V | 1200V | 2300V |
| 90μA TO | 800V | 1500V | 1150V | 600V | 1000V | 2200V |
| 110μA TO | 600V | 1300V | 950V | 600V | 800V | 2100V |

FIG. 20

TABLE. A THICKNESS (dy) OF CT LAYER OF PHOTOSENSITIVE DRUM (201Y) dy = 10 μm

| | THICKNESS OF CT LAYER OF PHOTOSENSITIVE DRUM OF CONTROLLED OBJECT | | | DEVELOPING BIAS CONTROL VALUE |
|---|---|---|---|---|
| | 10 μm | 12 μm | 15 μm | |
| Iya | 10 μA TO | 12 μA TO | 15 μA TO | −355V |
| | 30 μA TO | 36 μA TO | 45 μA TO | −370V |
| | 50 μA TO | 60 μA TO | 75 μA TO | −380V |
| | 70 μA TO | 84 μA TO | 105 μA TO | −390V |
| | 90 μA TO | 108 μA TO | 135 μA TO | −400V |
| | 110 μA TO | 132 μA TO | 165 μA TO | −410V |

TABLE. B THICKNESS (dy) OF CT LAYER OF PHOTOSENSITIVE DRUM (201Y) dy = 12 μm

| | THICKNESS OF CT LAYER OF PHOTOSENSITIVE DRUM OF CONTROLLED OBJECT | | | DEVELOPING BIAS CONTROL VALUE |
|---|---|---|---|---|
| | 10 μm | 12 μm | 15 μm | |
| Iya | 8 μA TO | 10 μA TO | 13 μA TO | −335V |
| | 25 μA TO | 30 μA TO | 38 μA TO | −350V |
| | 42 μA TO | 50 μA TO | 63 μA TO | −365V |
| | 58 μA TO | 70 μA TO | 88 μA TO | −375V |
| | 75 μA TO | 90 μA TO | 113 μA TO | −385V |
| | 92 μA TO | 110 μA TO | 138 μA TO | −395V |

TABLE. C THICKNESS (dy) OF CT LAYER OF PHOTOSENSITIVE DRUM (201Y) dy = 15 μm

| | THICKNESS OF CT LAYER OF PHOTOSENSITIVE DRUM OF CONTROLLED OBJECT | | | DEVELOPING BIAS CONTROL VALUE |
|---|---|---|---|---|
| | 10 μm | 12 μm | 15 μm | |
| Iya | 7 μA TO | 8 μA TO | 10 μA TO | −310V |
| | 20 μA TO | 24 μA TO | 30 μA TO | −325V |
| | 33 μA TO | 40 μA TO | 50 μA TO | −340V |
| | 47 μA TO | 56 μA TO | 70 μA TO | −350V |
| | 60 μA TO | 72 μA TO | 90 μA TO | −360V |
| | 73 μA TO | 88 μA TO | 110 μA TO | −370V |

FIG. 24

| TRANSFERRING CURRENT VALUE Ia | DEVELOPING BIAS CONTROL VALUE | | |
|---|---|---|---|
| | THICKNESS OF CT LAYER = 10 μm | THICKNESS OF CT LAYER = 12 μm | THICKNESS OF CT LAYER = 15 μm |
| 10 μA TO | −325V | −305V | −280V |
| 30 μA TO | −340V | −320V | −295V |
| 50 μA TO | −350V | −335V | −310V |
| 70 μA TO | −360V | −345V | −320V |
| 90 μA TO | −370V | −355V | −330V |
| 110 μA TO | −380V | −365V | −340V |

IMAGE FORMING APPARATUS HAVING A TRANSFER CURRENT DETECTION DEVICE AND CONTROL FOR DEVELOPING BIAS IN NON-IMAGE AREA

BACKGROUND OF THE INVENTION

1. Field of the Invention

The present invention relates to an image forming apparatus such as an electrophotographic apparatus, an electrostatic recording apparatus, etc.

2. Related Background Art

The general operations of an image forming apparatus such as an electrophotographic apparatus, an electrostatic recording apparatus, etc. are described below by referring to FIG. 22.

FIG. 22 shows an entire configuration of an example of a typical image forming apparatus, that is, an image forming apparatus for forming an image on a transferring material using an electrophotographic process.

An electrophotographic photosensitive member (hereinafter referred to as a photosensitive drum) 1, which is a drum-shaped image bearer, and is rotation-driven at a predetermined process speed in the direction of an arrow R9 shown in FIG. 22, and an image forming process such as a charging process, an image exposing process, a developing process, a transferring process, a cleaning process, etc. is performed on the photosensitive drum 1.

The above mentioned image forming process of forming an image to a transferring material is described as follows. First, the rotation-driven photosensitive drum 1 is charged such that its surface can have predetermined polarity and predetermined potential by a primary charging unit 2. In the following explanation, the photosensitive drum 1 is assumed to be charged to have negative polarity.

Then, the surface of the photosensitive drum 1 which is charged to have the negative polarity of predetermined potential is image-exposed by an exposing unit 3 (for example, a projection exposing unit for an original image, an image-modulated laser beam scanning exposing unit, etc.) as an image information write means, thereby attenuating the charging potential of the image-exposed portion (exposed light portion) and forming an electronic latent image corresponding to the exposed image information on the surface of the photosensitive drum 1.

The electronic latent image formed on the surface of the photosensitive drum 1 is sequentially made into a visible image as a transferable toner image by developing a toner image by a developing roller 4*a* of a developing unit 4 in a developing portion N6.

The system of exposing and developing the surface of the equally charged photosensitive drum 1 can be a normal developing system of exposing a background portion (in which no images are formed) of the image information on the surface of the charged photosensitive member, and developing the portion (in which an image is formed) other than the background portion, and a reversal developing system of exposing the portion of the image information, and developing the exposed portion.

Then, the toner image formed on the surface of the photosensitive drum 1 by a development portion N6 is transferred on the transferring portion N5 by the transferring means to the transferring material (transfer sheet) fed by a sheet feeding apparatus 13. The above mentioned transferring means can be, for example, a roller-shaped contact transfer charging unit (hereinafter referred to as a transferring roller 9). The transferring roller 9 is formed by, for example, a plug and an elastic layer enclosing the plug with the transferring portion N5 (transfer nip portion) formed by pressure-welding the layer to the photosensitive drum 1 with a predetermined pressure, thereby rotating the roller in the direction of the rotation of the photosensitive drum 1 (the R10 direction shown in FIG. 8) at a process speed almost equal to the process speed of the photosensitive drum 1 in the transferring portion N5.

Furthermore, the transferring material fed by the sheet feeding apparatus 13 is conveyed by a resist roller 15. The transferring material is conveyed to the transferring portion N5 such that when the tip portion of the toner image formed on the surface of the photosensitive drum 1 reaches the transferring portion N5, the tip portion of the transferring material can simultaneously reach the transferring portion N5.

The transferring material conveyed to the transferring portion N5 tightly contacts the photosensitive drum 1, held by the transferring portion N5 while the toner image is transferred from the photosensitive drum 1. In the period from the arrival of the tip portion of the transferring material at the transferring portion N5 to the passage of the rear portion of the transferring material through the transferring portion N5, a transferring bias (voltage) of predetermined positive polarity from a transferring bias (voltage) power supply not shown in the attached drawings is applied to the plug of the transferring roller 9.

In the process of the transferring material nipped and conveyed by the transferring portion N5, the toner image on the photosensitive drum side is sequentially transferred to the transferring material by the effect (of the transferring roller 9 of the positive polarity attracting the toner of the negative polarity) of the transfer field formed by the transferring roller 9 as a contact transfer charging unit and the pressure in the transferring portion N5.

Afterwards, when the rear end of the transferring material passes the transferring portion N5, the transferring material is separated from the surface of the photosensitive drum 1 and conveyed to a fixing unit 12, and the toner image transferred to the transferring material is fixed onto the surface of the transferring material as a permanently fixed image, and is then discharged as an image product (copy, print, etc.).

After the rear end of the transferring material passes the transferring portion N5, the accretion such as residual toner, powdered paper, etc. is removed (swept) from the surface of the photosensitive drum 1 by a cleaner 10. If images are continuously formed, a charging roller is repeatedly provided in forming an image. The residual toner, the powdered paper, etc. are stored in a waste toner container 11.

SUMMARY OF THE INVENTION

The present invention aims at providing an improved image forming apparatus. Furthermore, the present invention aims at providing an image forming apparatus including: an image bearer for bearing an image formed by a transferring material; a charging portion for charging an image bearer by predetermined potential; an exposing portion for forming an electronic latent image by exposing an image forming area of the image bearer charged by predetermined potential; a developing portion for developing an electronic latent image on the image bearer so that an image to be formed on the transferring material can be formed on the image bearer, wherein a voltage set in the developing portion for the image forming area of the image bearer is different from a voltage set in the developing portion for the non-image-forming area of the image bearer; a transferring portion for transferring an image formed on the image bearer to a transferring material; a transferring current detecting portion for detecting the transferring current flowing through the transferring portion; and a control portion for controlling the voltage set in the developing portion, wherein the voltage set on the developing portion of the image bearer is controlled based on the transferring current value detected by the transferring current detecting portion.

Another object of the present invention will become more apparent by reference to the following detailed description of the invention taken in conjunction with the accompanying drawings.

BRIEF DESCRIPTION OF THE DRAWINGS

FIG. 17 is a transferring bias (voltage) table;

FIG. 18 is a table showing the relationship between the transferring current value Ia in the developing bias control in a non-image-forming area and the developing bias control value;

FIG. 19 is a transferring bias (voltage) table;

FIG. 20 is a table showing the relationship between the transferring current value Iya in the developing bias control in a non-image-forming area and the developing bias control value;

FIG. 24 is a table showing the relationship between the transferring current value Ia in the developing bias control in a non-image-forming area and the developing bias control value.

DESCRIPTION OF THE PREFERRED EMBODIMENTS (First Embodiment)

The first embodiment of the present invention is described by referring to the attached drawings.

The operations of the image forming apparatus such as the electrophotographic apparatus, the electrostatic recording apparatus, etc. are described below by referring to FIG. 1.

Figure 1:
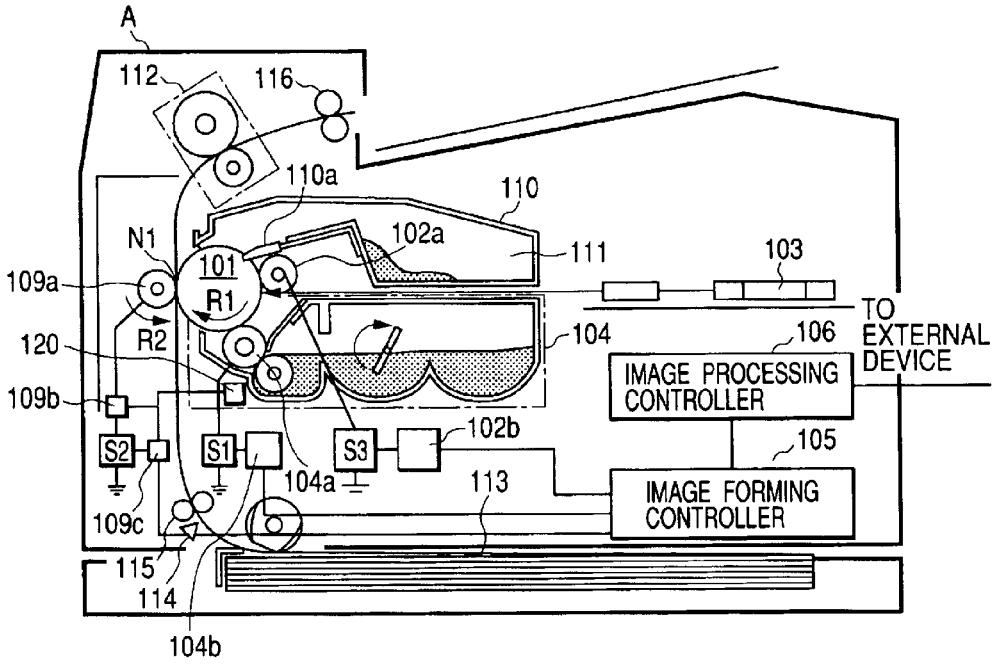
FIG. 1 shows the entire configuration of the image forming apparatus.

FIG. 1 shows the entire configuration of the image forming apparatus according to first embodiment of the present invention. The image forming apparatus shown in FIG. 1 forms an image on a transferring material in the electrophotographic system, for example, a laser beam printer. In the following explanation, the image forming apparatus is assumed to perform a reversal developing process using a negatively charged photosensitive drum 101 and toner with negative charge. It is obvious that the present invention is not limited to the image forming apparatus for performing the reversal developing process, but can be applied to an apparatus for performing a normal developing process.

The image forming apparatus shown in FIG. 1 comprises an electrophotographic photosensitive member (hereinafter referred to as a photosensitive drum) 101 as an image bearer. The photosensitive drum 101 is mounted as freely rotatable by the main body A of the image forming apparatus (hereinafter referred to simply as an "apparatus body A"), and is rotation-driven in the direction of the arrow R1 by the driving means (not shown in the attached drawings).

The photosensitive drum 101 is surrounded along the rotation direction (R1) by a primary charging unit 102 for equally charging the surface of the photosensitive drum, an exposing unit 103 for forming an electronic latent image according to the image information on the surface of the photosensitive drum 101 after the charging process, a developing unit 104 for developing an electronic latent image, a transferring unit 109 for transferring a toner image on the photosensitive drum 101 to a transferring material such as paper sheets, and a cleaning apparatus 110 for removing the residual toner on the photosensitive drum 101 after the primary transfer.

Described below is the supplementary explanation of each member, etc. described above.

The photosensitive drum 101 is configured by, for example, providing an OPC (organic photo-semiconductor) photosensitive layer (hereinafter referred to as a photosensitive layer) having negative charge polarity on the surface of a cylindrical aluminum plug. The photosensitive layer comprises a charge carrier generation layer (hereinafter referred to as a CG layer) and a charge carrier transport layer (hereinafter referred to as a CT layer), and the thickness of the CT layer is 15 $\mu$m in the initial state according to the present embodiment, and can be up to about 10 $\mu$m after friction depending on the durability.

The primary charging unit 102 as charging means comprises a charging roller 102*a* contacting the surface of the photosensitive drum 101, and a high charging voltage source S3 for applying the DC voltage to the charging roller 102*a* for charging the surface of the photosensitive drum 101 with the desired surface potential Vd, thereby equally charging the surface of the photosensitive drum 101 in the DC charging roller system. The DC voltage applied by the high charging voltage source S3 to the charging roller 102*a* is controlled by a charging voltage control portion 102*b*.

The exposing unit 103 as exposing means comprises, for example, a laser oscillator for emitting a laser beam according to image information, a polygon mirror, etc., and forms an electronic latent image on the surface of the photosensitive drum 101 by removing the charge of the laser-irradiated portion by scanning the surface of the photosensitive drum after the charging process.

The developing unit 104 as developing means comprises the developing roller 104*a* contacting the surface of the photosensitive drum 101 and a high developing voltage source S1 for applying a desired developing voltage thereto. The developing unit 104 stores negative toner having a negative charge by friction. The negative toner adheres to the portion (exposed portion) from which the charge of the electronic latent image on the surface of the photosensitive drum 101 is removed, and is then developed, thereby developing the electronic latent image as a toner image. The developing voltage applied to the developing roller 104*a* by the high developing voltage source S1 can be set by a developing voltage control portion 104*b*. The developing roller 104*a* can be attached to and detached from the photosensitive drum 101 by an image forming controller 105 described later, and contacts the photosensitive drum 101 when an image is formed.

The transferring unit 109 as transferring means comprises the transferring roller 109*a* arranged opposite the photosensitive drum 101 and contacting the surface of the photosensitive drum 101, a high transferring voltage source S2 for applying a desired transferring bias T to the transferring roller 109*a*, and a transferring current detecting portion 109*b* for detecting the current through the transferring roller 109*a*, nips the transferring material such as paper sheet, etc. by a transfer nip portion N1 in which the photosensitive drum 101 is arranged opposite the transferring roller 109*a*, and transfers the toner image on the photosensitive drum 101 to the transferring material by applying the positive voltage from the reverse side of the transferring material in the transferring roller system. The transferring bias T applied to the transferring roller 109*a* by the high transferring voltage source S2 can be controlled by a transferring voltage control portion 109*c* at an instruction from the image forming controller 105 to be described later.

The transferring bias T applied to the transferring roller 109*a* is determined by the transferring current value Ia, which flows between the transferring roller 109*a* and the photosensitive drum 101 when a predetermined DC voltage is applied to the transferring roller 109*a* before performing the image forming operation and is detected by the transferring current detecting portion 109*b*, and the quality (thickness, electric resistance value, water content, type (a standard sheet, an OHT sheet, etc.)) of the transferring material determined by a material quality detecting portion 114 for detecting the quality of the transferring material, and the determined transferring bias T is applied to the transferring roller 109*a* when the toner image is transferred to the transferring material.

The cleaning apparatus 110 comprises a cleaner 110*a* for removing the residual toner after the primary transfer which contacts and adheres to the surface of the photosensitive drum.

The photosensitive drum 101, the charging roller 102*a*, the developing unit 104, and the cleaning apparatus 110 are integrated as a cartridge, and improves the exchangeability of consumable items by configuring the above mentioned components as detachably attachable to the main body of the image forming apparatus.

The image forming controller 105 controls each component configuring the above mentioned image forming apparatus. The image forming controller 105 is connected to an image process controller 106 for receiving and processing image information and print instruction from an external apparatus such as a personal computer, etc., and controls each component configuring the image forming apparatus at the instruction from the image process controller 106. For example, it totally controls the charging voltage control portion 102*b* for setting the DC voltage applied to the charging roller 102*a* from the high charging voltage source S3, the developing voltage control portion 104*b* for setting the developing voltage applied to the developing roller 104*a* from the high developing voltage source S1, and the transferring voltage control portion 109*c* for setting the transferring bias T applied to the transferring roller 109*a* from the high transferring voltage source S2.

The above mentioned type (a standard sheet, an OHT sheet, etc.) of the transferring material is determined by a command transmitted to the image process controller 106 together with image data to be printed from an external apparatus, and a signal input by an operating portion such as an operation panel, etc. connected to the image forming controller 105.

The operations of the image forming apparatus with the above mentioned configuration are described below.

The surface of the photosensitive drum 101 is charged equally at −500 V in the N/N environment (23° C./600% RH) by the primary charging unit 102 applying the DC voltage −1000 V obtained by adding the voltage −500 V corresponding to V th (discharge starting voltage of the photosensitive drum) to the DC voltage −500 V to the charging roller 102*a*.

The surface potential Vd of the charged photosensitive drum 101 fluctuates by the voltage applied to the charging roller 102*a*, the environment of the image forming apparatus, the discharge starting voltage V th depending on the thickness of the CT layer, etc. in the DC charging roller system used in the first embodiment.

The discharge starting voltage V th increases by about 50 V depending on the environment H/H (temperature of 30° C./humidity of 80% Rh)→L/L (temperature of 15° C./humidity of 10% Rh), and decreases by about 50 V depending on the thickness of the CT layer (15 μm→10 μm).

Figure 2:
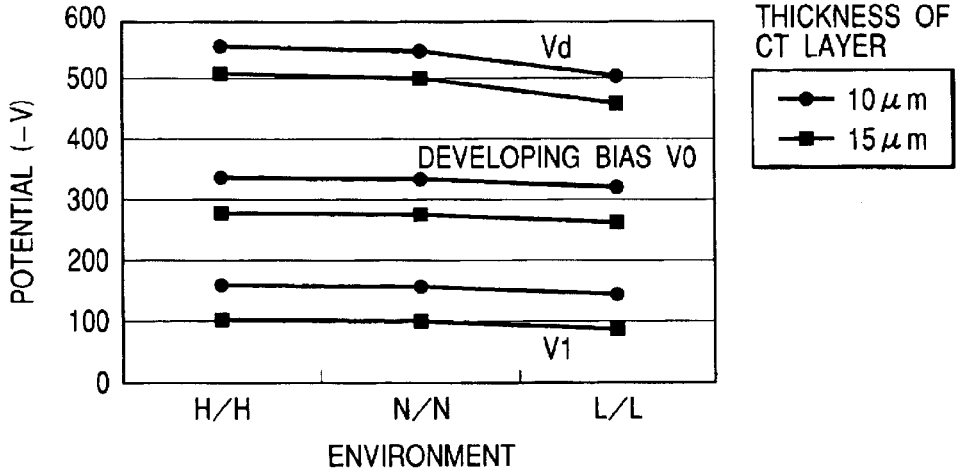
FIG. 2 shows the light portion potential (surface potential) Vd of an unexposed portion of a photosensitive drum, a developing bias V0 set for an image forming area, and a light portion potential VI of an exposed portion VI whose changes depending on an environment are shown by referring to the thickness of a plurality of CT layers.

FIG. 2 shows the changes of the light portion potential (surface potential) Vd of the unexposed portion, the developing bias V0 set for the image forming area, the light portion potential VI of an exposed portion of the photosensitive drum relative to a plurality of thicknesses of the CT layer.

Specifically, it is a graph having the horizontal axis as a change of the environment and the vertical axis as the potential of the photosensitive drum when a constant voltage (−1000 V) is applied to the charging roller 102*a*. The circle shown in FIG. 2 indicates that the thickness of the CT layer is 10 μm, and the square indicates that the thickness of the CT layer is 15 μm. The three environments marked with the circles and squares depending on the change of environments correspond to the above mentioned H/H (temperature of 30° C./humidity of 80% Rh), N/N (23° C./60% Rh), and L/L (temperature of 15° C./humidity of 10% Rh). As for the vertical axis, the temperature and humidity gradually decrease from left to right (from the H/H environment to the L/L environment).

Then, an electronic latent image can be formed after the exposing unit 103 exposes the image forming area on the photosensitive drum 101 according to the image information. The image forming area refers to an area on the photosensitive drum 101, indicates an area of a predetermined margin added by the exposing unit 103 to the area which can be exposed (by scanning with a laser beam, etc.) according to the image information, and depends on the size of the transferring material forming an image. The non-image-forming area refers to an area on the photosensitive drum 101, and an area on which the exposure is mandatorily suppressed not to perform exposure (scanning with a laser beam) by the exposing unit 103 according to the image information. The non-image-forming area is, for example, an area on the photosensitive drum 101 through which the developing roller 104*a* passes during the initial rotation, an area on the photosensitive drum 101 corresponding to the interval between sheets on which an image is continuously formed on the transferring material, and an area on the photosensitive drum 101 through which the developing roller 104*a* passes during the post-rotation.

The initial rotation refers to an operation for stabilizing the surface potential of the photosensitive drum 101 as a preprocess, and the surface potential of the photosensitive drum 101 can be stabilized by applying for a predetermined time a voltage to the charging roller 102*a* by the high charging voltage source S3, a voltage to the developing roller 104*a* by the high developing voltage source S1, and a voltage to the transferring roller 109*a* by the high transferring voltage source S2.

The interval between sheets refers to the portion on which no images are formed between transferring materials when an image is continuously formed on a plurality of transferring materials.

The post-rotation refers to the operation performed to stabilize the surface potential of the photosensitive drum 101 in preparation for the next image forming operation when the image forming operation terminates, and is similar to the process of the above mentioned operation for the initial rotation.

On the surface of the photosensitive drum 101 exposed by the exposing unit 103, the light portion potential Vd of the unexposed portion (the background portion of an image of the image forming area not exposed by the exposing unit) is −500V, and the light portion potential VI of the exposed portion (the portion of an image of the image forming area exposed by the exposing unit) is −100V.

When the thickness of the CT layer is 15 μm (when the photosensitive drum 101 is new), the developing bias of −280 V is applied to the developing roller 104*a* of the developing unit 104 from the high developing voltage source S1. Then, the potential (surface potential) Vd of the unexposed portion of the surface of the photosensitive drum 101 is −500 V relative to the developing bias V0 of −280V, thereby the developing bias V0 being higher in potential by 220 V. As a result, the negative toner charged for negative polarity and stored in the developing unit 104 does not adhere to the surface of the photosensitive drum 101. However, the charging amount of the toner depends on the level of the durability of the toner, thereby possibly adhering to the photosensitive drum as fog toner to some extent.

Relative to the developing bias V0 or −280 V set on the image forming area of the photosensitive drum 101, the light portion potential VI in the exposed portion of the surface of the photosensitive drum 101 is −100 V, thereby the developing bias V0 being higher in potential by 180 V. As a result, the negative toner charged for negative polarity and stored in the developing unit 104 adheres to the surface of the photosensitive drum 101, and forms (develops) a toner image.

The developing bias V0 set for the image forming area is controlled by the image forming controller 105 such that the potential difference (hereinafter referred to as a development contrast) between the developing bias V0 and the light portion potential VI can be constantly 180 V to stabilize the image density against the fluctuating dark portion potential Vd and light portion potential VI of the photosensitive drum (refer to FIG. 2).

The photosensitive drum 101 and the transferring roller 109*a* rotate in the directions of the arrows R1 and R2 respectively at almost the same speed, and the transferring bias T1 is applied by the high transferring voltage source S2 to the transferring roller 109*a*. Thus, the toner image on the photosensitive drum 101 is transferred to the transferring material such as a paper sheet conveyed by the effect (of the toner having the negative polarity attracted by the transferring roller 109*a* having the positive polarity) of the transfer field formed by the potential difference between the photosensitive drum 101 and the transferring roller 109*a* in the transfer nip portion N1 and the pressure in the transfer nip portion N1.

At this time, the residual toner remaining not transferred on the transferring material after the transfer on the surface of the photosensitive drum 101 is removed by the cleaning blade 110*a* of the cleaning apparatus 110, and stored in a waste toner container 111.

The transferring material transferred for a toner image is formed as a permanently fixed image by a fixing apparatus 112, and then discharged by an discharge roller 116.

Thus, the operation of the image forming apparatus is described above. When the unexposed portion of the surface of the photosensitive drum 101 (the portion of the surface potential Vd) passes through the developing roller 104*a*, the toner charging amount depends on the level of the durability of toner, thereby causing the problem of a small amount of fog toner as the accretion on the photosensitive drum. The problem is described below.

When the image forming apparatus is used for a long time, the toner deteriorates in the developing unit 104 depending on the use of the developing unit 104, thereby generating toner without sufficient charge (hereinafter referred to as low tribo-toner), or toner inversely charged in charge polarity (hereinafter referred to as reverse toner against the normal toner with desired charge polarity).

Therefore, the above mentioned low tribo-toner or reverse toner is transferred, that is, a fog phenomenon can occur on the non-image-forming area of the photosensitive drum 101 such as the unexposed portion of the image forming area in the reversal developing system, an area corresponding to the interval between sheets when an image is continuously formed on the transferring materials, an area on which the developing roller 104*a* passes through during the initial rotation, etc. The toner forming the fog is referred to as fog toner.

The fog toner in the image forming area in which a toner image is transferred to the transferring material is directly transferred to the transferring material by the transfer nip portion N1, but is not directly transferred to the transferring roller 109*a*. Since the amount of the fog toner transferred to the transferring material is the amount for one image forming operation on the photosensitive drum 101, the fog is almost invisible on the sheet normally used. Therefore, the influence of the fog toner in the image forming area on the image formed on the transferring material is not serious.

On the other hand, the fog toner in the non-image-forming area on the photosensitive drum is transferred to the transferring roller 109*a* without being transferred directly to the transferring material. Therefore, fog toner is gradually accumulated on the transferring roller 109*a*, and develops as spots on the reverse (surface opposite an image forming surface) of the transferring material when the transferring material passes the accumulated fog toner.

As for the above mentioned fog toner, the fog occurring by the low tribo-toner is normally referred to as ground fog, and frequently occurs when the difference (contrast) between the dark portion potential (surface potential) Vd of the unexposed portion in the reversal developing system and the potential of the developing bias applied to the developing roller 104*a* is small.

The fog occurring from reverse toner is normally referred to as reverse fog, and frequently occurs when the difference (contrast) between the dark portion potential (surface potential) Vd of the unexposed portion in the reversal developing system and the potential of the developing bias applied to the developing roller 104*a* is large.

However, the contrast (referred to as back contrast for convenience while the potential difference between the developing bias and the exposed portion in the reversal developing system is referred to as a development contrast) depends mainly on the image density and the development contrast. Therefore, it is not always adjusted to the value with which the ground fog or the reverse fog cannot occur. As a result, the fog of the unexposed portion of the non-image-forming area or the image forming area is transferred on the photosensitive drum 101.

To solve the problems of the fog, conventionally the cleaning bias is applied to the transferring roller 109*a* when an image forming operation terminates, etc. to clean the toner accumulated on the transferring roller 109*a*. However, while the transferring roller 109*a* is not cleaned during the continuous printing process, etc., the fog also appears as spots on the reverse (surface opposite the image forming surface) of the transferring material.

Therefore, as the first embodiment, the method of appropriately controlling the developing bias (voltage) set by the developing voltage control portion 104*b* when the non-image-forming area of the photosensitive drum 101 passes the developing roller 104*a* such that the fog toner cannot occur in the non-image-forming area in which the influence of the fog to the transferring material is serious is described below.

Before starting the image forming operation, the photosensitive drum 101 and the transferring roller 109*a* are rotated in the directions of the arrows R1 and R2 respectively by the driving means not shown in the attached drawings.

At this time, the high transferring voltage source S2 applies the DC voltage of 1000 v to the transferring roller 109*a*. The transferring current detecting portion 109*b* detects the transferring current value Ia of the current flowing between the transferring roller 109*a* to which the voltage is applied and the photosensitive drum 101. Although the high transferring voltage source S2 applies a constant (1000 V) to the transferring roller 109*a*, the transferring current value Ia detected by the transferring roller 109*b* can be different depending on the environment of the image forming apparatus. A different transferring current value Ia is obtained when the resistance value of the transferring portion comprising the transferring roller 109*a*, etc. changes depending on the environment of the image forming apparatus.

Figure 3:
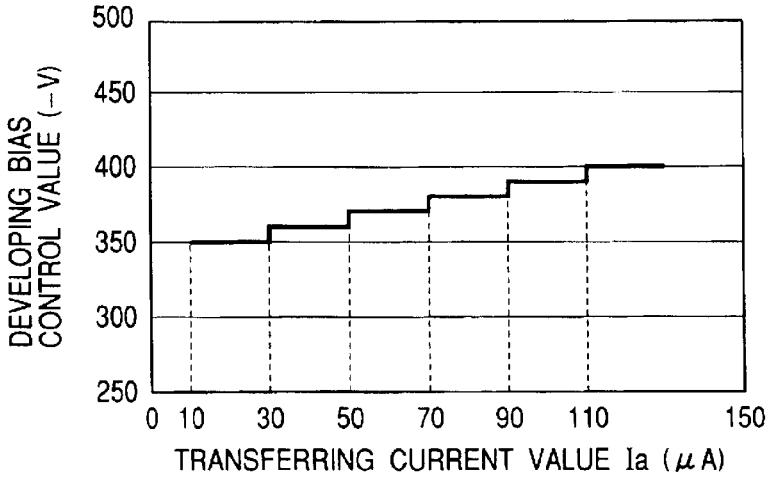
FIG. 3 shows the relationship between the transferring current value Ia and the developing bias control value V in the developing bias control in a non-image-forming area.

FIG. 3 shows the relationship between the transferring current value Ia in controlling the develop bias in the non-image-forming area and the developing bias control value V.

Figures 4, 5:
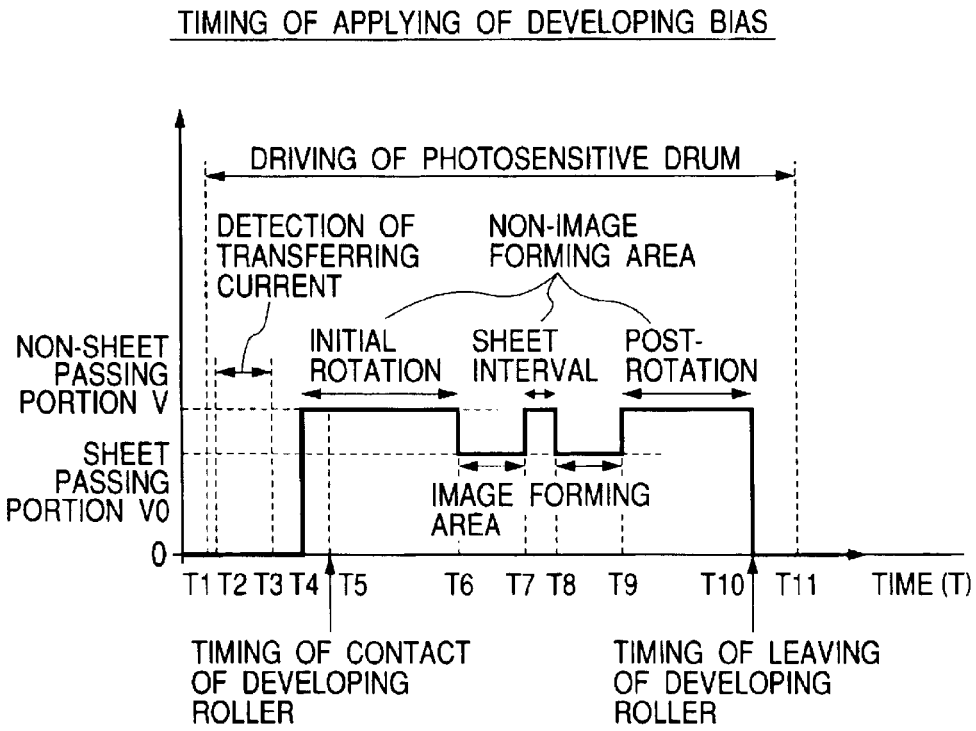
FIG. 4 is a table showing the relationship between the transferring current value Ia and the developing bias control value V in the developing bias control in a non-image-forming area.
FIG. 5 shows in a time series of changes in the voltage applied to a developing roller 104*a* when images of two pages are continuously formed on the transferring material.

In FIG. 3, the vertical axis indicates the developing bias control value V set such that the toner cannot be transferred to the photosensitive drum 101 to be fog toner when the non-image-forming area of the photosensitive drum 101 passes through the developing roller 104*a*. By setting different developing bias control values V depending on the transferring current value Ia of the current flowing through the transferring roller 109*a* which is represented by the horizontal axis, the appropriate developing bias can be applied to the developing roller 104*a* depending on the environment of the image forming apparatus, thereby avoiding the occurrence of the fog toner. The relationship between the transferring current value Ia and the developing bias control value V is experimentally determined in advance, and is stored in the memory (storage portion) provided in the image forming controller 105 as a table as shown in FIG. 4. The preparation of the table is described later.

The transferring current detecting portion 109*b* is connected to the transferring voltage control portion 109*c* as shown in FIG. 1, and the transferring voltage control portion 109*c* sets the developing bias V to be applied to the developing roller 104*a* by the high developing voltage source S1 based on the transferring current value Ia of the current flowing through the transferring roller 109*a*. For example, when the value of the transferring current value Ia input from the transferring current detecting portion 109*b* to the image forming controller 105 through the transferring voltage control portion 109*c* is 55 $\mu$A, the value is between 50 $\mu$A and 70 $\mu$A as shown on the table shown in FIG. 4. Therefore, the image forming controller 105 sets −370 V as a developing bias control value V. Then, the developing voltage control portion 104*b* controls the high developing voltage source S1 such that the developing bias control value V (−370 V as shown in FIG. 4) set by the image forming controller 105 can be applied to the developing roller 104*a*.

In the first embodiment, the developing bias control value V is appropriately selected based on the conversion table shown in FIG. 4. However, when the relationship between the transferring current value Ia and the developing bias control value V is represented by a simple function (for example, a linear function), the function can be computed by a conversion expression indicating the function. In this case, using the conversion expression, the memory capacity can be saved, and the process speed can be increased.

Described above is the method of setting the developing bias value applied to the developing roller 104*a* when the non-image-forming area of the photosensitive drum 101 passes the developing roller 104*a*, and the timing of setting the developing bias for the non-image-forming area of the photosensitive drum 101 is described below by referring to FIG. 5.

FIG. 5 shows the change in developing bias (voltage) applied to the developing roller 104*a* in a time series when images of two pages are continuously formed on the transferring material.

First, at timing T1, the drive of the photosensitive drum 101 is started. Then, at timing T2, the high transferring voltage source S2 applies predetermined transferring bias T (1000 V) to the transferring roller 109*a* to set the developing bias control value V depending on the environment of the image forming apparatus based on the table shown in FIG. 4. At this time, the transferring current value Ia of the current flowing through the transferring roller 109*a* is detected by the transferring current detecting portion 109*b*. Thus, the transferring current is detected as shown in FIG. 5, thereby terminating the operation at timing T3.

Then, at timing T4, the rotation of the developing roller 104*a* is started when the initial rotation starts, and the developing bias control value V in the non-image-forming area determined by the transferring current detecting operation is applied to the developing roller 104*a*. At timing T4, the developing roller 104*a* is detached from the photosensitive drum 101. At timing T5, the developing roller 104*a* contacts the photosensitive drum 101 charged with the dark portion potential Vd by the charging roller 102*a*.

When the initial rotation process terminates and the image forming area on the photosensitive drum 101 reaches the position opposite the developing roller 104*a* (timing T6), the developing bias is changed from the developing bias control value V to the developing bias V0 (refer to FIG. 2) for forming an image. Then, in timing T7, when the portion corresponding to the interval between sheets reaches the position opposite the developing roller 104*a*, the developing bias is changed from the developing bias V0 (for example, −280 V) obtained when an image is formed to the developing bias control value V in the non-image-forming area.

When the image forming area for an image on the second page reaches the position opposite the developing roller 104*a*, the developing bias is changed again from the developing bias control value V to the developing bias V0 (refer to FIG. 2) for forming an image. Then, at the timing (timing T9) of passing the image forming area of the image on the second page, the developing bias is changed from the developing bias V0 (for example, −280 V) obtained when an image is formed to the developing bias control value V in the non-image-forming area.

In the explanation above, the transferring current value Ia is detected when an image is formed, but it can be detected in other methods. For example, the transferring current value Ia can be detected when power is supplied to the image forming apparatus, and the detection result can be stored in the memory provided for the image forming controller 105, etc., and the developing bias control value V of the non-image-forming area can be set based on the transferring current value Ia stored in the memory each time an image is formed (each time one print job is performed) Furthermore, since the change in the environment of the image forming apparatus is to be obtained, the transferring current value Ia is first detected, and a new transferring current value Ia can be detected each time a predetermined time passes.

Figure 6:
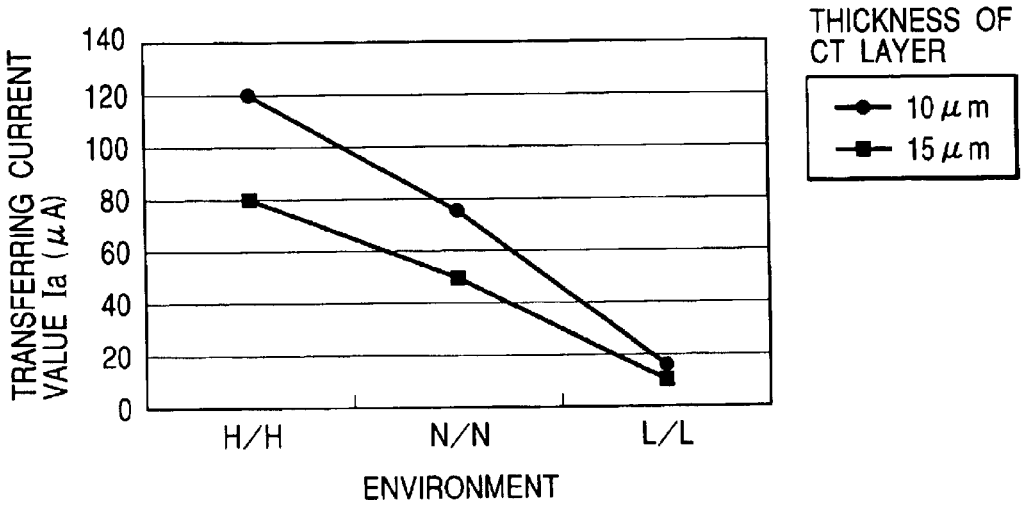
FIG. 6 shows the changes of the transferring current value Ia depending on the environments of the image forming apparatus by referring to the thickness of a plurality of CT layers when a constant transferring bias T (1000 V) is applied to a transferring roller 109*a;*

The influence of the environment of the image forming apparatus and the thickness of the CT layer of the photosensitive drum 101 on a detected transferring current is explained below by referring to FIG. 6. FIG. 6 shows a change of the transferring current value Ia depending on the environment of the image forming apparatus and the thickness of the CT layer when a constant transferring bias T (1000 V) is applied to the transferring roller 109*a*.

As shown in FIG. 6, the transferring current value Ia of the current flowing through the transferring roller 109*a* fluctuates depending on the resistance value of the transferring roller 109*a* changing depending on the environment of the image forming apparatus, and the thickness of the CT layer of the photosensitive drum 101 although the transferring bias T applied to the transferring roller 109*a* is constant. Practically, the lower the temperature and the humidity in the environment of the image forming apparatus, the higher the resistance value of the transferring roller 109*a*, thereby lowering the value of the transferring current value Ia. The higher the thickness of the photosensitive drum 101, the lower the electrostatic capacity of the CT layer, thereby lowering the value of the transferring current value Ia.

Figure 7:
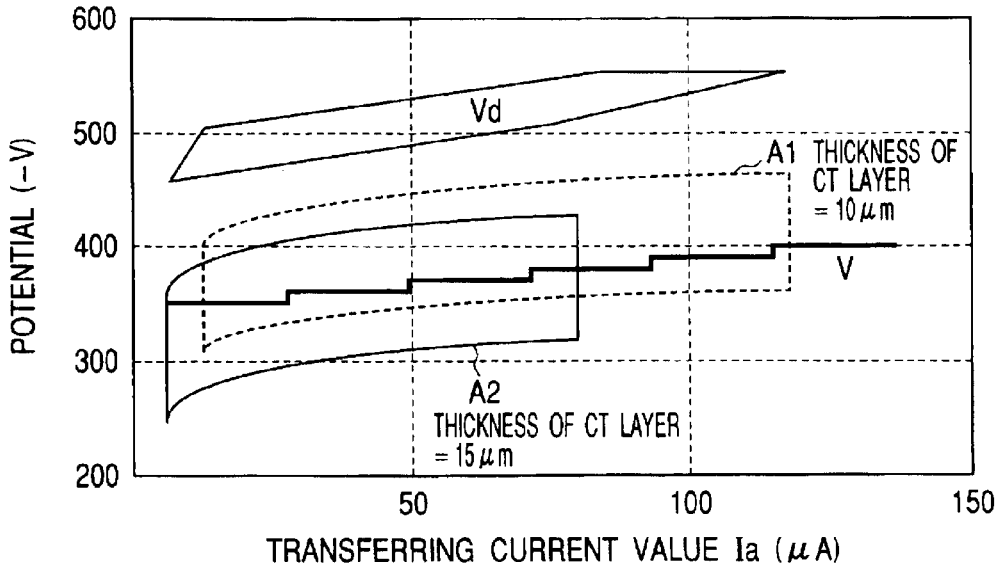
FIG. 7 shows the changes of the transferring current value Ia, the surface potential Vd of a photosensitive drum, and the appropriate range of the developing bias in the non-image-forming area.
Figure 8:
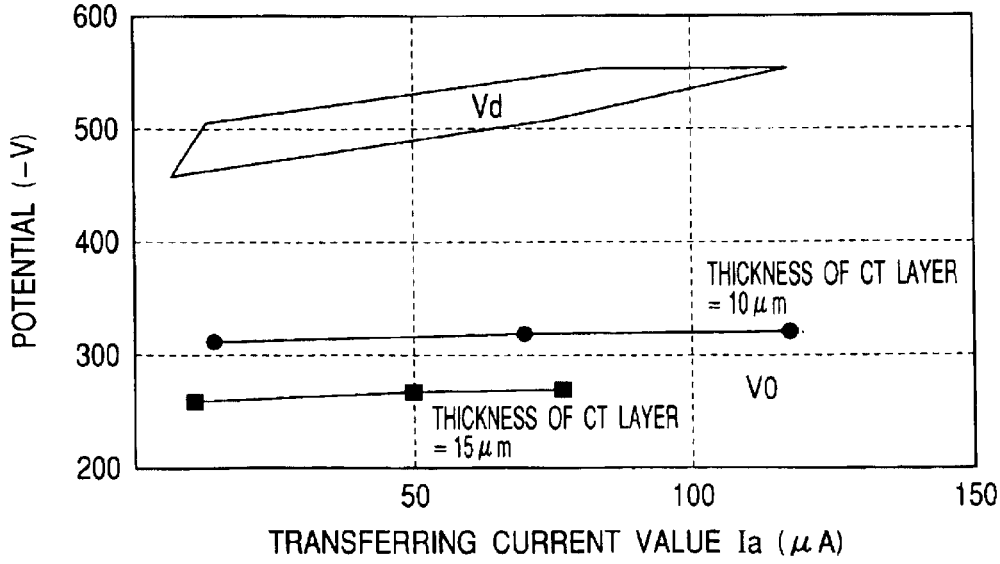
FIG. 8 shows the changes of the transferring current value Ia, the surface potential Vd of a photosensitive drum, and the developing bias V0 set for the image forming area in the image forming area.

FIGS. 7 and 8 show the relationship between the change of the transferring current value Ia depending on the environment of the image forming apparatus and the thickness of the CT layer and the fluctuation of the surface potential of the photosensitive drum shown in FIG. 2 and the developing bias on the environment.

FIG. 7 shows the change of the transferring current value Ia, the surface potential Vd of the photosensitive drum, and the appropriate range of the developing bias in the non-image-forming area. FIG. 8 shows the change of the transferring current value Ia, the surface potential Vd of the photosensitive drum, and the developing bias V0 applied to the image forming area in the image forming area.

The ground fog and the reverse fog occur due to the deterioration of the toner depending on the durability as described above. An area A1 shown in FIG. 7 indicates the appropriate range of the developing bias V with which the fog (ground fog and reverse fog) does not occur for the surface potential Vd which can be changed depending on the environment, etc. when the thickness of the CT layer is 10 μm. The area A1 is experimentally determined. When the developing bias V is lower than the area A1 (when the back contrast is 100 V or lower), the ground fog occurs. When the developing bias V is higher than the area A1 (when the back contrast is 200 V or higher), the reverse fog occurs.

An area A2 shown in FIG. 7 indicates the appropriate range of the developing bias V with which the fog does not occur for the surface potential Vd which can be changed depending on the environment, etc. when the thickness is 15 μm. The area A2 is experimentally determined as the area A1. When the developing bias V is lower than the area A2

(when the back contrast is 100 V or lower), the ground fog occurs. When the developing bias V is higher than the area A2 (when the back contrast is 200 V or higher), the reverse fog occurs.

As described above, to set the developing bias V such that the ground fog and the reverse fog cannot occur regardless of the thickness of the CT layer, the developing bias V in the area in which the areas A1 and A2 overlap each other is to be set. Then, the developing bias control value V for the transferring current value Ia set as a table shown in FIG. 4 is a value indicated by a stepwise solid line as shown in FIG. 7, and is set to be the developing bias in the area in which the areas A1 and A2 overlap each other.

FIG. 8 shows the change of the transferring current value Ia, the surface potential Vd of the photosensitive drum, and the developing bias V0 set for the image forming area, and is described below for comparison with FIG. 7.

In FIG. 8, an area exceeding the range of the areas A1 and A2 shown in FIG. 7 occurs with the developing bias appropriate value V0 in the image forming area, but the amount of fog toner occurring in the image forming area increases as compared with the case in which the area is in the range of the areas A1 and A2. However, since the toner in the image forming area is directly transferred to the transferring material during the transfer, it is not prominent because only the fog generated in one developing process is transferred.

On the other hand, the fog in the non-image-forming area is directly transferred to the transferring roller 109*a*, and it is accumulated on the transferring roller 109*a* as the rotation is repeated. Therefore, when a transferring material such as paper sheets, etc. is conveyed to the space between the photosensitive drum 101 and the transferring roller 109*a*, the accumulated fog toner is transferred to the reverse of the transferring material and appears as toner spots.

Therefore, according to the first embodiment, the dark portion potential Vd of the photosensitive drum 101 is estimated using the transferring current value Ia of the transferring roller 109*a* according to the graph shown in FIG. 7 in the non-image-forming area requiring no consideration of the image density, etc. Based on the estimation, the developing bias with the back contrast of 100 to 200 V can be selected.

The obtained control table is the table indicating the relationship between the transferring current value Ia shown in FIG. 4 and the developing bias control value V.

As described above, the back contrast can be set within a predetermined range regardless of the fluctuation of the resistance value of the transferring portion comprising the transferring roller 109*a*, etc. and the fluctuation of the thickness of the CT layer of the photosensitive drum by the environment, thereby suppressing or decreasing the occurrence of the fog in the non-image-forming area, and suppressing the spots on the reverse of the sheets by accumulating the toner on the transferring roller by the fog.

With the configuration of the first embodiment of the present invention, in the environments of L/L, N/N, and H/H, a durability test is conducted on 10,000 sheets corresponding to the durability of a cartridge with a good printing result without any toner spots on the reverse of the sheets.

In the first embodiment, a transferring roller is used as transferring means, but a transferring brush, a transferring brush roller, etc. can be used with similar effects.

The initial setting values such as a voltage value, etc. shown in the first embodiment is not limited to these values, but any appropriate value can be selected if it results in the effect of the first embodiment.

(Second Embodiment)

The second embodiment of the present invention is described below by referring to the attached drawings.

Figure 9:
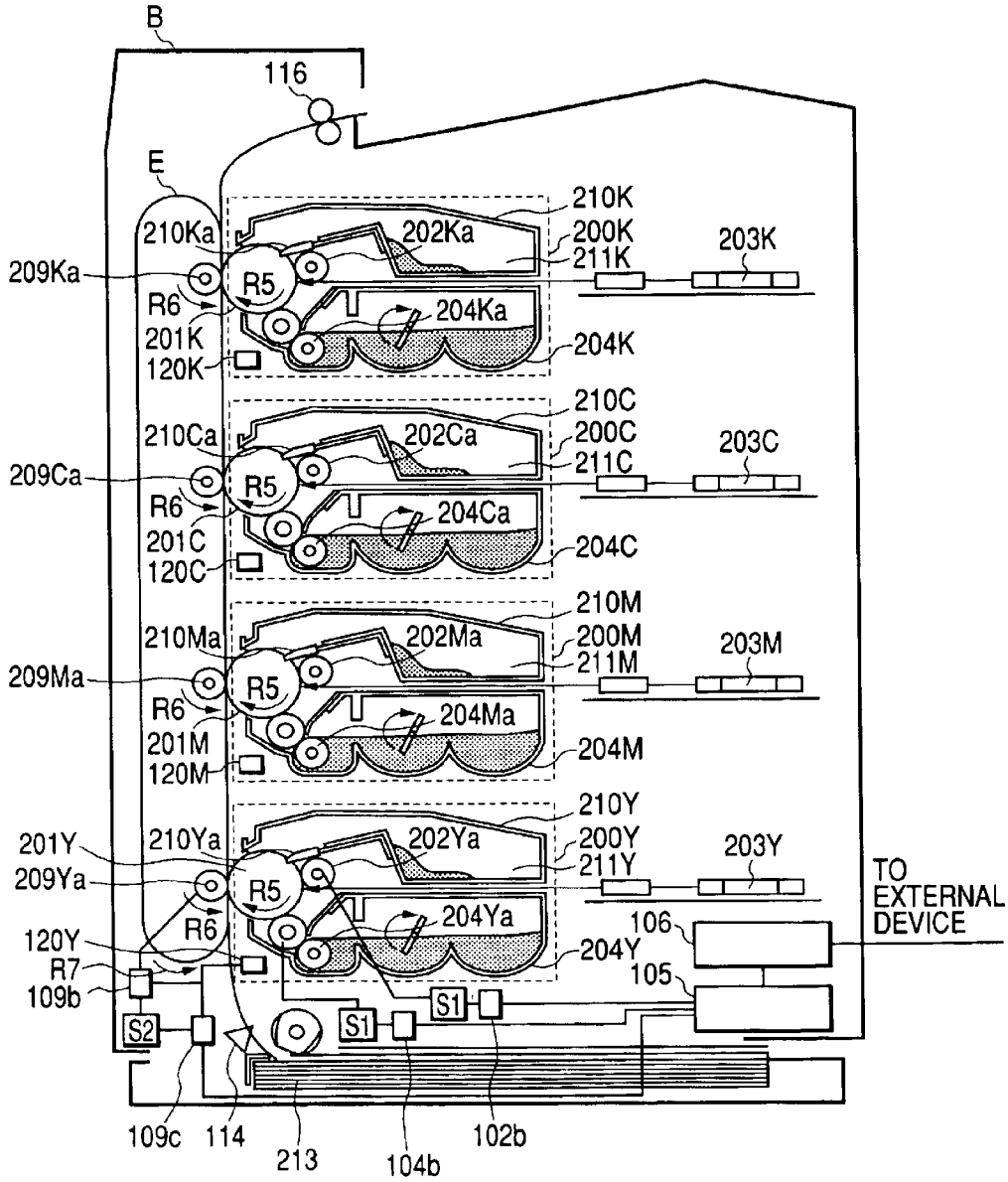
FIG. 9 shows the entire configuration of a full-color image forming apparatus.

The second embodiment is applied to the full-color image forming apparatus capable of forming a full-color image using a plurality of colors in addition to the features of the first embodiment FIG. 9 is the entire configuration of the full-color image forming apparatus of the second embodiment.

The image forming apparatus shown in FIG. 9 forms an image on a transferring material in the electrophotographic system such as a laser beam printer, etc. The second embodiment comprises a cartridge 200 having each portions (a photosensitive drum, a charging unit, a developing unit, a cleaning device, etc.) as integrated for forming an image as in the first embodiment. The cartridge 200 is prepared for each toner of yellow, magenta, cyan, and black which are arranged in a row parallel to the transferring material conveying belt E, each cartridge is sequentially layered, and a full-color image forming apparatus forms a full-color image on the transferring material. Each cartridge is set detachably attachable to the main body of the image forming apparatus.

The image forming apparatus shown in FIG. 9 comprises a drumshaped electrophotographic photosensitive members (hereinafter referred to as photosensitive drum) 201Y, 201M, 201C, and 201K. The photosensitive drum 201 is mounted as freely rotatable by the main body B of the image forming apparatus (hereinafter referred to simply as an "apparatus body B", and is rotation-driven in the direction of the arrow R5 by the driving means (not shown in the attached drawings).

In the following explanation, each portion forming a cartridge 204Y of yellow (Y) is described, but the similar configurations are designed for a cartridge 204M of magenta (M), a cartridge 204C of cyan (C), and a cartridge 204K of black (K) with the similar operations. Therefore, the detailed explanation is omitted here.

The photosensitive drum 201Y is surrounded along the rotation direction (R5) by a primary charging unit 202Y for equally charging the surface of the photosensitive drum, an exposing unit 203Y for forming an electronic latent image according to the image information on the surface of the photosensitive drum 201Y after the charging process, a developing unit 204Y for developing an electronic latent image, a transferring unit 209Y for transferring a toner image on the photosensitive drum 201Y to a transferring material, and a cleaning apparatus 210Y for removing the residual toner on the photosensitive drum 201Y after the primary transfer.

The details of each portion are similar to those explained in the first embodiment, and the photosensitive drum 201Y, the primary charging unit 202Y, the exposing unit 203Y, the developing unit 204Y, the transferring unit 209Y, and the cleaning apparatus 210Y according to the second embodiment respectively correspond to the photosensitive drum 101, the primary charging unit 102, the exposing unit 103, the developing unit 104, the transferring unit 109, and the cleaning apparatus 110 according to the first embodiment. Similar configurations are held for the cartridges other than the cartridge for yellow (Y).

Each portion configuring the above mentioned image forming apparatus is controlled by the image forming controller 105. The image forming controller 105 is connected to the image process controller 106 for receiving and processing image information and a print instruction transmitted from an external apparatus such as a personal computer, etc., and controls each portion configuring the image forming apparatus at an instruction from the image process controller 106. For example, it integrally controls the charging voltage control portion 102*b* for controlling the DC voltage to be applied by the high charging voltage source S3 to a charging roller 202Ya, the developing voltage control portion 104*b* for controlling the developing voltage to be applied by the high developing voltage source S1 to a developing roller 204Ya, and the transferring voltage control portion 109*c* for controlling the transferring bias T to be applied by the high transferring voltage source S2 to a transferring roller 209Ya. The application of the voltages to charging rollers 202*a* (202Ma, 202Ca, 202Ka) provided for the cartridges of colors other than yellow (Y), developing rollers 204*a* (204Ma, 204Ca, and 204Ka), and a transferring roller 209 is also controlled by the image forming controller 105.

In the image forming apparatus according to the second embodiment with the above mentioned configuration, as in the first embodiment, the transferring current value Ia detected by the transferring current detecting portion 109*b* and an appropriate (not generating a ground fog or an reverse fog) control value of the developing bias V are experimentally obtained and stored in the image forming controller 105 as a conversion table to set a developing bias V such that no ground fog or reverse fog can be made regardless of the thickness of the CT layer of the photosensitive drum 201Y or the environment of the image forming apparatus. When an image is formed, the thickness of the CT layer of the photosensitive drum 201Y and an appropriate developing bias V in a non-image-forming area corresponding to the environment of the image forming apparatus are set using the transferring current value Ia detected by the transferring current detecting portion 109*b* and the conversion table, thereby forming an image without fog. The operation of setting the developing bias V from the transferring current value Ia is the same as the operation in the first embodiment.

Since the cartridge 204M of magenta (M), the cartridge 204C of cyan (C), the cartridge 204K of black (K) other than the cartridge 204Y of yellow (Y) have similar configurations, the developing bias V in each cartridge can set the developing bias control value V in the similar method to the cartridge of yellow (Y) based on the transferring current value Ia detected by the transferring current detecting portion (not shown in the attached drawings) of each cartridge and the predetermined conversion table. The conversion table can be a common table among the colors as shown in FIG. 4, or different conversion tables can be prepared for the respective colors.

Unlike the first embodiment, the second embodiment has a transferring material conveying belt E between the photosensitive drum 201Y and the transferring roller 209Ya. Therefore, the transferring current detecting portion 109*b* detects the current flowing between the transferring roller 209Ya and the photosensitive drum 201 through the transferring material conveying belt E, and the occurrence of the spots on the reverse of the sheets can be suppressed without accumulating the fog toner on the transferring material conveying belt E.

In the explanation above, the developing roller 104*a* of each color controls the voltage set in the non-image-forming area by detecting the transferring current value Ia in each cartridge 200 of yellow (Y), magenta (M), cyan (C), and black (K). However, the transferring current value Ia can be detected only for yellow (Y), and the transferring current value Ia can be assumed to be a transferring current value of the current flowing through the transferring roller 109*a* of other colors magenta (M), cyan (C), and black (K), or a transferring current value Ia is computed for each color by adding correction for each color to the transferring current value Ia detected for yellow (Y), thereby controlling the developing bias of the non-image-forming area.

In the former, since there is the case in which there can be different ranges of the back contrast with which the fog can be suppressed by the characteristic of each color toner, a table of the developing bias V for the transferring current value Ia can be generated for each color for effective application.

In the latter, when the transferring current value Ia is detected only for yellow (Y), it is not necessary to provide a plurality of transferring current detecting portions. Therefore, various merits such as reducing cost, requiring a smaller power supply, etc. can be obtained.

With the configuration of the second embodiment of the present invention, in the environments of L/L, N/N, and H/H, a durability test is conducted on 10,000 sheets of full-color print corresponding to the durability of a cartridge with a good printing result without any toner spots on the reverse of the sheets as in the first embodiment.

The transferring means for the transferring bias from the reverse of the transferring material conveying belt E is not limited to the transferring roller according to the present embodiment, but can be a blade-shaped, brush-shaped, brush roller, etc. can be available.

(Third Embodiment)

The third embodiment is described below by referring to the attached drawings.

The image forming apparatus according to the third embodiment of the present invention has the same configuration as the first embodiment shown in FIG. 1.

Therefore, the functions, operations, etc. of each portion of the image forming apparatus are the same as those explained in the first embodiment, and the detailed explanation is omitted here.

In the first embodiment of the present invention, the transferring current value Ia of the current flowing through the photosensitive drum 101 and the transferring roller 109*a* is detected, and an appropriate developing bias control value V not generating fog in the non-image-forming area is set from the table stored in advance based on the detection result.

The third embodiment is a variation of the first embodiment, an appropriate developing bias not generating fog in the non-image-forming area is set depending on the fluctuation of the thickness of the CT layer of the photosensitive drum in addition to the detection result of the transferring current value Ia.

Normally, the thickness of the CT layer which is the charge conveying layer of the photosensitive drum is thinner when the photosensitive drum is used, and the discharge starting voltage also decreases correspondingly. Therefore, regardless of the use of the photosensitive drum (thickness of the CT layer), when a constant charging voltage is applied by the high charging voltage source S3 to the charging roller 102*a*, the charging potential of the photosensitive drum is different between the case in which the photosensitive drum is new (when the thickness of the CT layer is thick) and the case in which the photosensitive drum is not new (when the thickness of the CT layer is thin). Therefore, the fog of the non-image-forming area becomes worse possibly.

Figure 10:
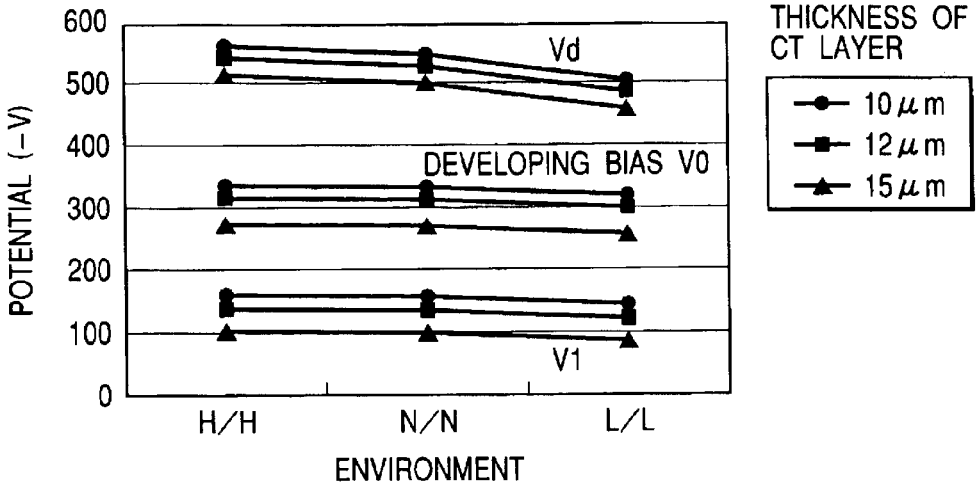
FIG. 10 shows the light portion potential (surface potential) Vd of an unexposed portion of a photosensitive drum, a developing bias V0 set for an image forming area, and a light portion potential VI of an exposed portion whose changes depending on an environment are shown by referring to the thickness of a plurality of CT layers.

FIG. 10 shows the changes of the light portion potential (surface potential) Vd of the unexposed portion, the developing bias V0 set for the image forming area, the light portion potential VI of an exposed portion of the photosensitive drum relative to a plurality of thicknesses of the CT layers. It is a graph having the horizontal axis as a change of the environment and the vertical axis as the potential of the photosensitive drum when a constant voltage (−1000 V) is applied to the charging roller 102*a*.

The circle (●) shown in FIG. 10 indicates that the thickness of the CT layer is 10 μm, the square (■) indicates that the thickness of the CT layer is 10 μm, and the triangle (Π) indicates that the thickness of the CT layer is 10 μm.

The three environments marked with the circles, squares, and triangles depending on the change of environments correspond to the above mentioned H/H (temperature of 30° C./humidity of 80% Rh), N/N (23° C./60% Rh), and L/L (temperature of 15° C./humidity of 10% Rh). As for the horizontal axis, the temperature and humidity gradually decrease from left to right (from the H/H environment to the L/L environment).

When the thickness of the CT layer is 15 μm (when the photosensitive drum 101 is new), the high developing voltage source S1 applies the developing bias V0 of −280 V to the developing roller 104*a* of the developing unit 104. Since the potential (surface potential) Vd of the unexposed portion of the surface of the photosensitive drum 101 is −500 V and the developing bias V0 is higher in potential by 220 V, the negative toner charged with negative polarity and stored in the developing unit 104 does not adhere to the surface of the photosensitive drum 101. However, the charging amount of the toner depends on the level of the deterioration of the toner, and the toner can adhere to the photosensitive drum as fog toner.

Since the light portion potential VI in the exposed portion of the surface of the photosensitive drum 101 relative to the developing bias V0 of −280 V set in the image forming area set in the image forming area set for the image forming area of the photosensitive drum 101 is −100 V, and the develop bias V0 is lower in potential by 180 V. Therefore, the negative toner charged with negative polarity and stored in the developing unit 104 adheres to the surface of the photosensitive drum 101, and is developed as a toner image.

Since the developing bias V0 in the image forming area has constant image density depending on the fluctuating dark portion potential Vd of the photosensitive drum and the potential VI of the exposed portion, the potential difference between the developing bias V0 and the light portion potential VI (hereinafter referred to as a development contrast) is controlled by the image forming controller 105 to be constantly 180 V (refer to FIG. 10).

The case in which the thickness of the CT layer is 15 μm (triangular mark shown in FIG. 10) is described above. When the thickness of the CT layer is changed (12 μm, and 10 μm), the light portion potential (surface potential) Vd of the unexposed portion, the developing bias V0, and the light portion potential VI of the exposed portion are different.

In the third embodiment, with the fluctuation of the environment of the image forming apparatus, the developing bias is appropriately controlled depending on the thickness of the CT layer. Therefore, the method of controlling the developing bias of the non-image-forming area (non-sheet passing area) is described below.

First, before starting the image forming operation, the photosensitive drum 101 and the transferring roller 109*a* are rotated by the driving means not shown in the attached drawings in the directions of the arrows R1 and R2 respectively.

Before or after the above mentioned operation, the thickness d of the CT layer of the photosensitive drum 101 is estimated according to the information stored in storage means, for example, ROM 120, provided in the cartridge including the developing unit 104. The storage means can be any means capable of electrically and magnetically storing data, for example, RAM, a magnetic disk, an optical disk, etc. To be more desirable, space-saving non-volatile storage means that does not need to be constantly fed with electricity, particularly, EPROM (erasable and programmable ROM) can be used.

The ROM 120 stores in advance a shaved amount α (μm) per unit time when the photosensitive drum 101 rotates, and a shaved amount β (μm) per unit time when the primary charging bias is applied by the charging roller 102*a*. The ROM 120 further stores the thickness of d1 of the CT layer in the initial step in use of the photosensitive drum, the use history information about the photosensitive drum 101 such as the total rotation time T1 from the initial step in use of the photosensitive drum, the total applying time T2 of the charging bias from the initial step in use of the photosensitive drum, etc.

Figure 23:
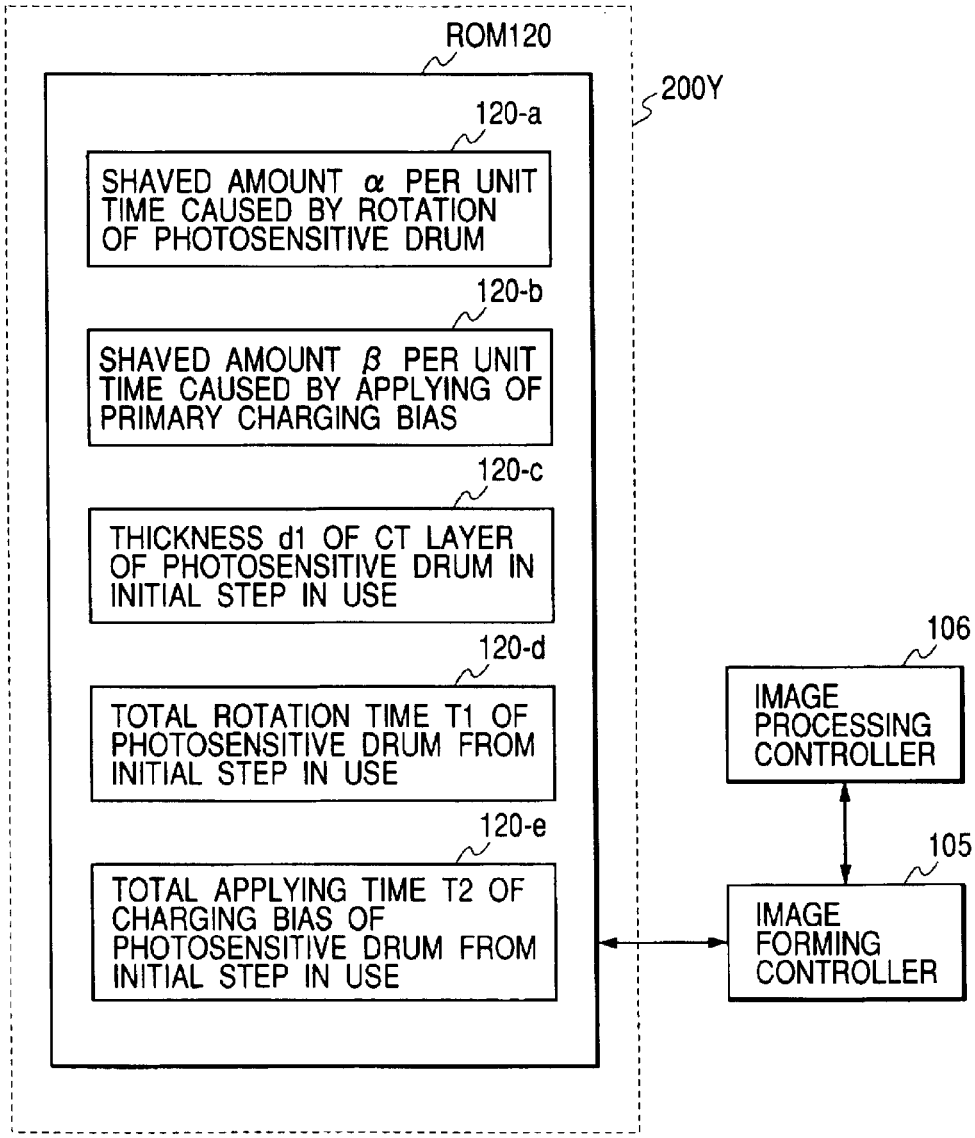
FIG. 23 shows the configuration of the memory provided for a cartridge.

The configuration of the ROM 120 is shown in FIG. 23. The shaved amount α per unit time when the photosensitive drum rotates is stored in a storage area 120-*a*. The shaved amount β per unit time when the primary charging bias is applied is stored in a storage area 120-*b*. The thickness of d1 of the CT layer in the initial step in use of the photosensitive drum is stored in a storage area 120-*c*. The total rotation time T1 from the initial step in use of the photosensitive drum is stored in a storage area 120-*d*. The total applying time T2 of the charging bias from the initial step in use of the photosensitive drum is stored in a storage area 120-*e*.

The values of T1 and T2 change in forming an image. For example, the values of the storage areas 120-*d* and 120-*e* of the ROM 120 are updated when the post-rotation is performed after completing a printing job input from an external device.

The ROM 120 is configured as communicable with the image forming controller 105, and the image forming controller 105 can write and read data to and from the ROM.

From the above mentioned α, β, d1, T1, and T2, for example, the thickness d of the CT layer of the photosensitive drum 101 can be computed by the following equation.

$$d = d1 - (\alpha \times T1 + \beta \times T2)$$

In the following explanation, the three types of thickness of the CT layer are 10 μm, 12 μm, and 15 μm. However, when the value of d computed by the equation above is 9 μm or more and less than 11 μm, the thickness of the CT layer is assumed to be 10 μm. When the value of d computed by the equation above is 11 μm or more and less than 13 μm, the thickness of the CT layer is assumed to be 12 μm. When the value of d computed by the equation above is 13 μm or more, the thickness of the CT layer is assumed to be 15 μm.

The use history of the photosensitive drum 101 includes the total rotation time T1 from the initial step in use of the photosensitive drum, and the total applying time T2 of the charging bias from the initial step in use of the photosensitive drum. However, the use history is not limited to these items. For example, it possibly includes the total number of rotations from the initial step in use of the photosensitive drum, the total applying time of the developing bias from the initial step in use of the photosensitive drum, and the total applying time of the transferring bias from the initial step in use of the photosensitive drum.

After the photosensitive drum 101 and the transferring roller 109*a* are rotated in the directions of the arrows R1 and R2 respectively by the driving means not shown in the attached drawings, the high transferring voltage source S2 applies the DC voltage of 1000 V to the transferring roller 109*a*. At this time, the transferring current value Ia of the current flowing between the transferring roller 109*a* and the photosensitive drum 101 after applying the voltage is detected by the transferring current detecting portion 109*b*.

As described above, FIG. 10 shows the surface potential Vd of the photosensitive drum, the developing bias V0 set for an image forming area, and the fluctuation depending on the environment of the light portion potential VI of the exposed portion for a plurality of thicknesses of the CT layers. The thinner the thickness of the CT layer, the larger in the negative direction the surface potential Vd of the photosensitive drum and the light portion potential VI of the exposed portion. Correspondingly, the developing bias V0 set for an image forming area of the photosensitive drum 101 becomes larger.

Figure 11:
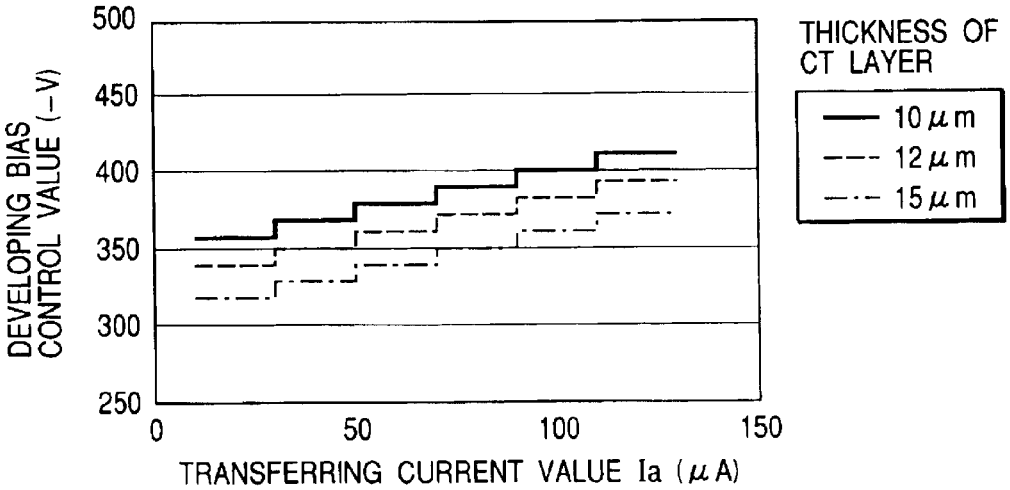
FIG. 11 shows the relationship between the transferring current value Ia and the developing bias control value V in the developing bias control in a non-image-forming area by referring to the thickness of a plurality of CT layers.

FIG. 11 shows the relationship between the transferring current value Ia in controlling the develop bias in the non-image-forming area and the developing bias control value V for a plurality of thicknesses of the CT layers.

In FIG. 11, the vertical axis indicates the developing bias control value V set such that the toner cannot be transferred to the photosensitive drum 101 to be fog toner when the non-image-forming area of the photosensitive drum 101 passes through the developing roller 104*a*. The horizontal axis indicates the transferring current value Ia of the current flowing through the transferring roller 109*a*. By setting different developing bias control values V depending on the transferring current value Ia of the current flowing through the transferring roller 109*a* which is represented by the horizontal axis, the appropriate developing bias control value V can be applied to the developing roller 104*a* depending on the environment of the image forming apparatus thereby avoiding the occurrence of the fog toner. The relationship between the transferring current value Ia and the developing bias control value V is experimentally determined in advance, and is stored in the memory (storage portion) provided in the image forming controller 105 as a table as shown in FIG. 12.

In the third embodiment, the voltage value is appropriate selected based on the conversion table shown in FIG. 11. However, when the relationship between the transferring current value Ia and the developing bias control value V is represented by a simple function (for example, a linear function), the function can be computed by a conversion expression indicating the function. In this case, using the conversion expression, the memory capacity can be saved, and the process speed can be increased.

Figures 12, 13:
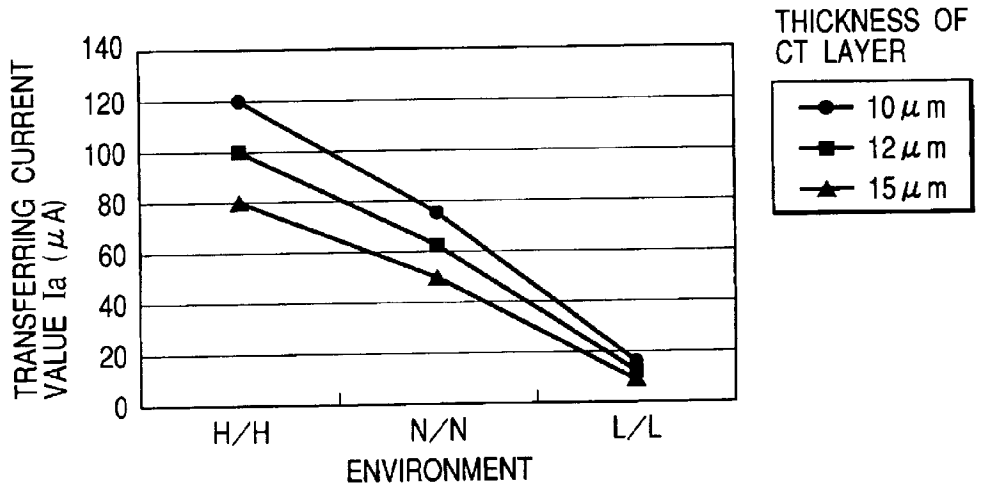
FIG. 12 is a table showing the relationship between the transferring current value Ia and the developing bias control value V in the developing bias control in a non-image-forming area.
FIG. 13 shows the changes of the transferring current value Ia depending on the environments of the image forming apparatus by referring to the thickness of a plurality of CT layers when a constant transferring bias T (1000 V) is applied to a transferring roller 109*a;*

The image forming controller 105 selects the developing bias control value V applied to the non-image-forming area using the table shown in FIG. 12 from the transferring current value Ia and the thickness of the CT layer computed from ROM 120. For example, if information indicating that the transferring current value Ia is 60 μA, and the thickness of the CT layer is 12 μm is stored in the ROM 120, then the image forming controller 105 sets the developing bias V of −360 V about the "thickness of CT layer=12 μm" in the column of the transferring current value Ia of "50 μA~". Then, at an instruction from the image forming controller 105, the developing voltage control portion 102*b* controls the developing bias (voltage) V to be applied to the developing roller 104*a* in the non-image-forming area of the photosensitive drum 101.

Described above is the method of setting the developing bias value V to be applied to the developing roller 104*a* when the non-image-forming area of the photosensitive drum 101 passes through the developing roller 104*a*. The timing of applying the developing bias to the non-image-forming area of the photosensitive drum 101 is the same as that explained above by referring to FIG. 5 according to the first embodiment of the present invention. Therefore, the detailed explanation is omitted here.

The influence of the environment of the image forming apparatus and the thickness of the CT layer of the photosensitive drum 101 on a detected transferring current is explained below by referring to FIG. 13. FIG. 13 shows a change of the transferring current value Ia depending on the environment of the image forming apparatus when a constant transferring bias T (1000 V) is applied to the transferring roller 109*a* for a plurality of thicknesses of the CT layer.

As shown in FIG. 13, the transferring current value Ia of the current flowing through the transferring roller 109*a* fluctuates depending on the resistance value of the transferring roller 109*a* changing depending on the environment of the image forming apparatus, and the thickness of the CT layer of the photosensitive drum 101 although the transferring bias T applied to the transferring roller 109*a* is constant. Practically, the lower the temperature and the humidity in the environment of the image forming apparatus, the higher the resistance value of the transferring roller 109*a*, thereby lowering the value of the transferring current value Ia. The higher the thickness of the photosensitive drum 101, the lower the value of the transferring current value Ia with the current difficult in flowing through the CT layer.

Figure 14:
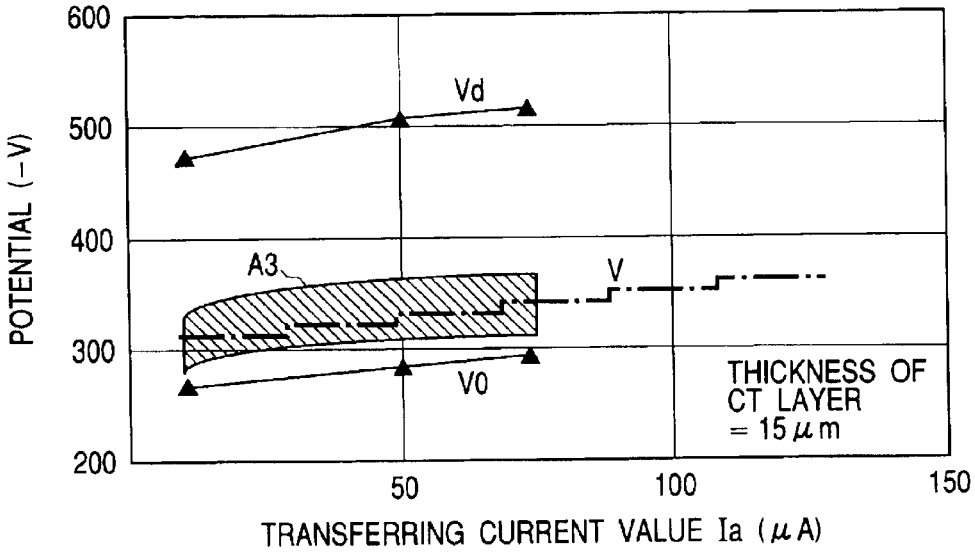
FIG. 14 shows the changes of the transferring current value Ia, the surface potential Vd of a photosensitive drum, and the changes by an environment of the appropriate range of the developing bias V in the non-image-forming area (thickness of CT layer=15 $\mu$m)
Figure 15:
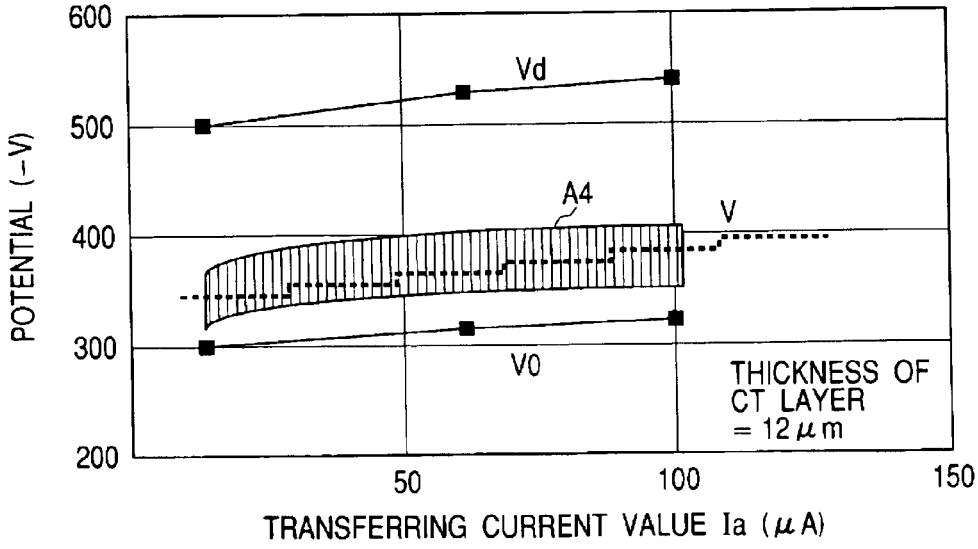
FIG. 15 shows the changes of the transferring current value Ia, the surface potential Vd of a photosensitive drum, and the changes by an environment of the appropriate range of the developing bias in the non-image-forming area (thickness of CT layer=12 $\mu$m)
Figure 16:
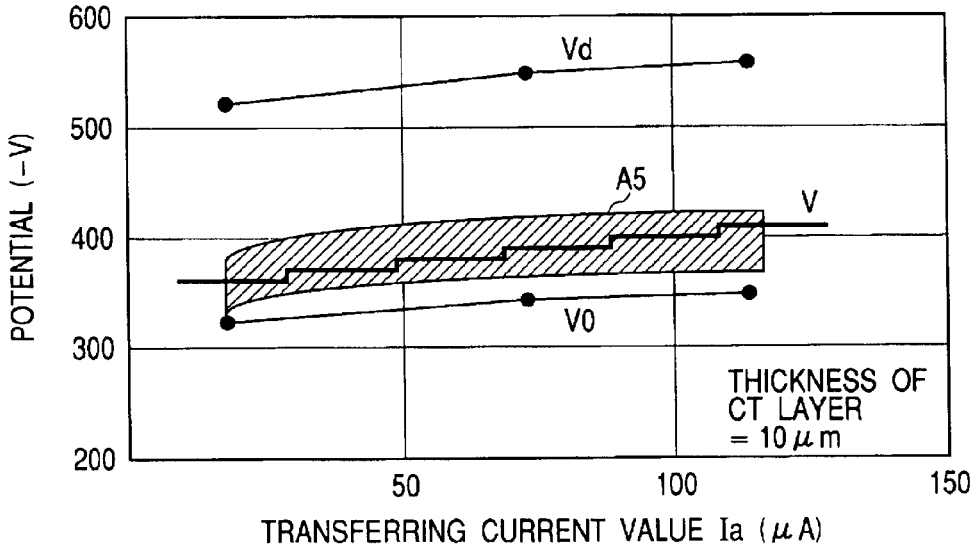
FIG. 16 shows the changes of the transferring current value Ia, the surface potential Vd of a photosensitive drum, and the changes by an environment of the appropriate range of the developing bias V in the non-image-forming area (thickness of CT layer=10 $\mu$m)

FIGS. 14, 15, and 16 show the relationship between the change of the transferring current value Ia depending on the environment of the image forming apparatus and the thickness of the CT layer shown in FIG. 13 and the fluctuation of the surface potential Vd of the photosensitive drum and the environment of the developing bias shown in FIG. 2.

FIGS. 14, 15, and 16 show the change of the transferring current value Ia, the surface potential Vd of the photosensitive drum, and the appropriate range of the developing bias V in the non-image-forming area. FIG. 14 shows the case in which the thickness of the CT layer is 15 μm. FIG. 15 shows the case in which the thickness of the CT layer is 12 μm. FIG. 16 shows the case in which the thickness of the CT layer is 10 μm.

The ground fog and the reverse fog occur due to the deterioration of the toner depending on the durability as described above. An area A3 shown in FIG. 14 indicates the appropriate range of the developing bias V with which the fog does not occur for the surface potential Vd which can be changed depending on the environment, etc. when the thickness of the CT layer is 15 μm. The area A3 is experimentally determined. When the developing bias V is lower than the area A3 (when the back contrast is 140 V or lower), the ground fog occurs. When the developing bias V is higher than the area A3 (when the back contrast is 180 V or higher), the reverse fog occurs.

As described above, to set the developing bias V such that the ground fog and the reverse fog cannot occur when the thickness of the CT layer is 15 μm, the developing bias V in the area A3 is to be set. Then, the developing bias V for the transferring current value Ia set as a table shown in FIG. 12 is a value indicated by stepwise broken lines as shown in FIG. 14, and is set to be the developing bias in the area A3.

FIG. 15 shows the case in which the thickness of the CT layer is 12 μm. FIG. 16 shows the case in which the thickness of the CT layer is 10 μm. As shown in FIG. 14, the developing bias V is set such that the developing bias in the area A4 is set in FIG. 15, and the developing bias in the area A5 is set in FIG. 16.

In FIGS. 14, 15, and 16, the developing bias V0 in the image forming area exceeds the area (the area A3 shown in FIG. 14, the area S4 shown in FIG. 15, and the area A5 shown in FIG. 16) of the developing bias in which no ground fog or reverse fog occurs, but the amount of fog toner occurring in the image forming area increases as compared with the case in which the area is not exceeded. However, in the state of the transfer to the transferring material such as paper, etc., it is not prominent because only the fog generated in one transferring process is transferred.

On the other hand, the fog in the non-image-forming area is directly transferred to the transferring roller 109*a*, and it is accumulated on the transferring roller 109*a* as the rotation is repeated. Therefore, when a transferring material such as paper sheets, etc. is conveyed to the space between the photosensitive drum 101 and the transferring roller 109*a*, the accumulated fog toner is transferred to the reverse of the transferring material and appears as toner spots.

Therefore, according to the third embodiment, the dark portion potential Vd of the photosensitive drum 101 is estimated using the transferring current value Ia of the transferring roller 109*a* according to the graph shown in FIGS. 14, 15, and 16 in the non-image-forming area requiring no consideration of the image density, etc. Based on the estimation, the developing bias with the back contrast of 140 to 180 V can be selected.

Furthermore, the area of the back contrast of 140 V or more and 180 V or less is different for each thickness of the CT layer of the photosensitive drum, and the above mentioned range of the back contrast cannot be satisfied in all areas of 10 $\mu$m or more and 15 $\mu$m or less, that is, the actual use area of the CT layer according to the present embodiment. Therefore, the fog can be more appropriately prevented by utilizing the information about the thickness of the CT layer of the photosensitive drum.

Thus, the obtained control table shows the relationship between the transferring current value Ia and the developing bias control value V as shown in FIG. 12.

By performing the processes described above, the back contrast can be within a predetermined range independent of the fluctuation of the environment, and the fluctuation of the thickness of the CT layer of the photosensitive drum, the occurrence of fog in a non-image-forming area can be prevented or reduced, and the toner from the fog can be reduced to the level of suppressing the accumulation on the transferring roller and the occurrence of the spots on the reverse of a printing sheet.

With the configuration of the third embodiment of the present invention, in the environments of L/L, N/N, and H/H, a durability test is conducted on 10,000 sheets corresponding to the durability of a cartridge with a good printing result without any toner spots on the reverse of the sheets.

In the third embodiment of the present invention, a transferring roller is used as a transferring means, but a transferring brush, a transferring brush roller, etc. can be used for the similar effect.

Additionally, the initial value of each voltage value, etc. in the third embodiment is not limited to this value, but any appropriate values can be selected if the effect of the present invention can be obtained.

(Fourth Embodiment)

The fourth embodiment of the present invention is described below by referring to the attached drawings.

The fourth embodiment is an application of the third embodiment to a full-color image forming apparatus, and an appropriate developing bias can be set without fog in a non-image-forming area with the fluctuation of the thickness of the CT layer of the photosensitive drum taken into account in addition to the detection result of the transferring current value Ia.

The full-color image forming apparatus according to the fourth embodiment has the configuration similar to that of the second embodiment as shown in FIG. 9.

Therefore, the functions, operation, etc. of each portion of the image forming apparatus are the same as those according to the second embodiment, and the explanation is omitted here.

Described below are the operations of the image forming apparatus according to the fourth embodiment of the present invention.

Before starting an image forming operation, the photosensitive drum 201 (201Y, 201M, 201C, and 201K) and the transferring roller 209*a* (209Ya, 209Ma, 209Ca, and 209Ka) are rotated by the driving means not shown in the attached drawings in the directions of the arrows R5 and R6 respectively.

Before or after the above mentioned operation, the thickness d (the thickness of the CT layer of the photosensitive drum 201Y is dy, the thickness of the CT layer of the photosensitive drum 201M is dm, the thickness of the CT layer of the photosensitive drum 201C is dc, and the thickness of the CT layer of the photosensitive drum 201K is dk) of the CT layer of the photosensitive drum 201 is estimated according to the information in the storage means, for example, the ROM 120 (120Y, 120M, 120C, and 120K) provided for each cartridge including a developing unit 204 (204Y, 204M, 204C, and 204K). The storage means can be means capable of electrically and magnetically storing data such as RAM, a magnetic disk, an optical disk, etc. To be more preferable, space-saving nonvolatile storage means that does not need to be constantly fed with electricity, particularly, EPROM (erasable and programmable ROM), is recommended.

The ROM 120 (120Y, 120M, 120C, and 120K) stores in advance a shaved amount $\alpha$ ($\mu$m) per unit time when the photosensitive drum 201 rotates, and a shaved amount $\beta$ ($\mu$m) per unit time when the primary charging bias is applied by the charging roller 102*a* (102Ya, 102Ma, 102Ca, and 102Ka). The ROM 120 (120Y, 120M, 120C, and 120K) further stores in ROM 120 the thickness of d1 of the CT layer in the initial step in use of the photosensitive drum, the use history information about the photosensitive drum 201 such as the total rotation time T1 from the initial step in use of the photosensitive drum, the total applying time T2 of the charging bias from the initial step in use of the photosensitive drum, etc. From the above mentioned $\alpha$, $\beta$, T1, and T2, the thickness d of the CT layer of the photosensitive drum 201 is computed by an expression, for example, $d=d1-(\alpha\times T1+\beta\times T2)$, etc.

The configuration of the ROM 120 (120Y, 120M, 120C, and 120K) is similar to the configuration described above by referring to FIG. 23, and the ROM 120 (120Y, 120M, 120C, and 120K) of each color is configured as communicable with the image forming controller 105.

Assume that: the thickness of the CT layer in the initial step in use (new) of the photosensitive drum 201Y of yellow (Y) is d1*y*, the rotation time is T1*y*, and the primary bias applying time is T2*y*; the thickness of the CT layer in the initial step in use of the photosensitive drum 201M of magenta (M) is d1*m*, the rotation time is T1*m*, and the primary bias applying time is T2*m*; the thickness of the CT layer in the initial step in use of the photosensitive drum 201C of cyan (C) is d1*c*, the rotation time is T1*c*, and the primary bias applying time is T2*c*; and the thickness of the CT layer in the initial step in use of the photosensitive drum 201K of black (K) is d1*k*, the rotation time is T1*k*, and the primary bias applying time is T2*k*. the thickness d (d1*y*, d1*m*, d1*c*, and d1*k*) of the CT layer of the photosensitive drum of each color is obtained by the following equations.

$$dy=d1y-(\alpha\times T1y+\beta\times T2y)$$

$$dm=d1m-(\alpha\times T1m+\beta\times T2m)$$

$$dc=d1c-(\alpha\times T1c+\beta\times T2c)$$

$$dk=d1k-(\alpha\times T1k+\beta\times T2m)$$

The use history of the photosensitive drum 101 includes the total rotation time T1 from the initial step in use of the photosensitive drum, and the total applying time T2 of the charging bias from the initial step in use of the photosensitive drum. However, the use history is not limited to these items. For example, it possibly includes the total number of rotations from the initial step in use of the photosensitive drum, the total applying time of the developing bias from the initial step in use of the photosensitive drum, and the total applying time of the transferring bias from the initial step in use of the photosensitive drum.

After the photosensitive drum 201Y and the transferring roller 209Ya are rotated in the directions of the arrows. R5 and R6 respectively by the driving means not shown in the attached drawings, the high transferring voltage source S2 applies the DC voltage of 1000 V to the transferring roller 209Ya. At this time, the transferring current value Iya of the current flowing between the transferring roller 209Ya and the photosensitive drum 201Y after applying the voltage is detected by the transferring current detecting portion 209Yb.

At this time, although the transferring current value Ia (Ima, Ica, and Ika respectively) of the current flowing between the transferring roller 209*a* (209Ma, 209Ca, and 209Ka) of M, C, and K and the photosensitive drum 201 (201M, 201C, and 201K) is not measured, but the transferring current value Ia of the current flowing when a predetermined voltage is applied to the transferring roller 209*a* is inversely proportional to the thickness of the CT layer of the photosensitive drum 201. Therefore, the transferring current value Ia can be obtained by the following equations from the transferring current value Iya of the current flowing in the transferring roller 209Ya and the value of the thickness d (dy, dm, dc, and dk) of the CT layer.

$$Ima=Iya\cdot dy/dm$$

$$Ica=Iya\cdot dy/dc$$

$$Ika=Iya\cdot dy/dk$$

Therefore, the transferring current values Ima, Ica, and Ika of the currents flowing in the transferring roller 209Ma of magenta (M), the transferring roller 209Ca of cyan (C), and the transferring roller 209Ka of black (K) can be obtained according to the transferring current value Iya detected by the transferring current detecting portion 109*b* on the transferring roller 209Ya of yellow (Y) and the thickness information about the CT layer of the photosensitive drum 201 stored in the ROM 120 of each cartridge. Then, the developing bias control value V is set for each color based on the transferring current values Iya, Ima, Ica, and Ika by referring to FIG. 12.

Described below is the method of setting the developing bias for the non-image-forming area of the photosensitive drum 201 from the developing roller 204*a* (204Ya, 204Ma, 204Ca, and 204Ka) of each color based on the transferring current value Ia (Iya, Ima, Ica, and Ika) of the current flowing through the photosensitive drum 201*a* (209Ma, 209Ca, and 209Ka) of each color.

The image forming controller 105 selects the developing bias control value V set for the non-image-forming area of the photosensitive drum 201 (201M, 201C, and 201K) using the table shown in FIG. 12 from the transferring current value Ia and the thickness of the CT layer computed from ROM 120. For example, if information indicating that the transferring current value Ia is 60 $\mu$A, and the thickness of the CT layer is 12 $\mu$A is stored in the ROM 120, then the image forming controller 105 sets −365 V as the developing bias control value V. Then, according to an instruction from the image forming controller 105, the charging voltage control portion 102*b* controls the developing bias (voltage) V to be applied to the developing roller 204*a* in the non-image-forming area of the photosensitive drum 201.

In FIG. 9, the transferring voltage control portion 109*c* and the high transferring voltage source S2 are provided only for the transferring roller 209Ya of yellow, but the transferring voltage control portion 109*c* (109*mc*, 109*cc*, and 109*kc*) not shown in the attached drawings is also provided with the high transferring voltage source S2 (S2*m*, S2*c*, and S2*k*) also for magenta (M), cyan (C), and black (K). Furthermore, the high developing voltage source S1 is also provided for magenta (M), cyan (C), and black (K) as the high developing voltage sources S1*m*, S1*c*, and S1*k* not shown in the attached drawings, and the high electrifying voltage source S3 is also provided for magenta (M), cyan (C), and black (K) as the high electrifying voltage source S3 (S3*m*, S3*c*, and S3*k*) not shown in the attached drawings.

The developing bias control value V to be applied to the developing roller 204*a* (204Ya, 204Ma, 204Ca, and 204Ka) of each color is set using the table shown in FIG. 12 based on the thickness information d (dy, dm, dc, and dk) of each CT layer and the transferring current value Ia.

Described below is another method of setting a developing bias to be applied to the developing roller 204*a* (204Ya, 204Ma, 204Ca, and 204Ka) of each color.

The method of setting the developing bias control value in the explanation above is to compute the transferring current value Ia (Ima, Ica, and Ika) of the current flowing through the transferring roller 209*a* of each color based on the transferring current value Iya of the current flowing through the transferring roller 209Ya of yellow (Y) and the thickness d (dy, dm, dc, and dk) of the photosensitive drum 201 of each color, and then set the developing bias control value V based on the table shown in FIG. 12.

On the other hand, the method described below is to set a developing bias to be applied to the developing roller 204*a* of each color based on a new table without computing the transferring current value Ia (Ima, Ica, and Ika) of the current flowing through the transferring roller 209*a* of each color based on the transferring current value Iya of the current flowing through the transferring roller 209Ya of yellow (Y) and the thickness d (dy, dm, dc, and dk) of the photosensitive drum 201 of each color. A new table is shown in FIG. 20, and is stored in the memory (not shown in the attached drawings), etc. of the image forming controller 105.

The method of setting a developing bias using the table shown in FIG. 20 is described below. FIG. 20 shows a combination of tables A, B, and C, and any of the tables is selected based on the thickness dy of the CT layer of the photosensitive drum 201Y. In each table, the "thickness of the CT layer to be controlled" refers to the thickness dm of the CT layer of the photosensitive drum 201M when, for example, the developing bias to be applied to the developing roller 204Ma of magenta (M) is set. Then, a developing bias control value V is selected based on the thickness of the CT layer to be controlled, and a transferring current value Iya, which flows to the transferring roller 209*a*.

For example, when the thickness dy of the CT layer of the photosensitive drum 201Y of yellow (Y) is 12 μm, and the transferring current value Iya is 38 μA, the developing bias control value V to be applied to the developing roller 204Ya is set in the following method.

First, since the thickness dy of the CT layer of the photosensitive drum 201Y of yellow (Y) is 12 μm, the table B is selected. Then, since the photosensitive drum to be controlled is also yellow (Y), the values of 12 μm of the CT layer and the transferring current value Iya=28 μA in the table B refer to Iya of 38 μA or more and 50 μA or less. Therefore, the developing bias control value of −350 V corresponding to this case is selected.

Thus, the method of setting the developing bias control value V applied from the developing roller 204*a* (204Y, 204M, 204C, and 204K) for the non-image-forming area of the photosensitive drum 201 (201Y, 201M, 201C, and 201K) is described above. Described next below by referring to 21 is the setting timing of the developing bias for the non-image-forming area of the photosensitive drum 201 (201Y, 201M, 201C, and 201K).

Figure 21:
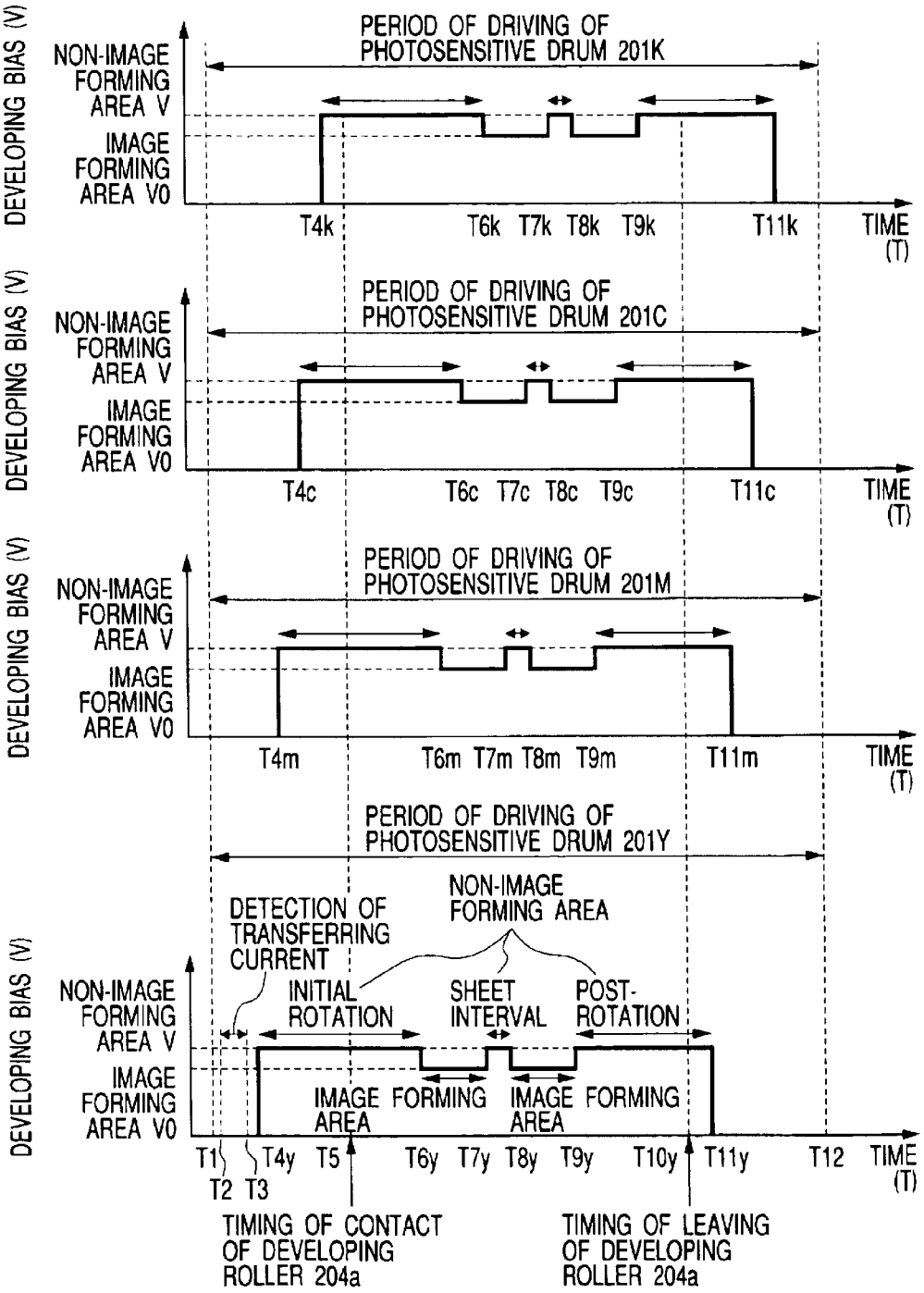
FIG. 21 shows in a time series of changes in the voltage applied to a developing roller 204*a* when images of two pages are continuously formed on the transferring material.
Figure 22:
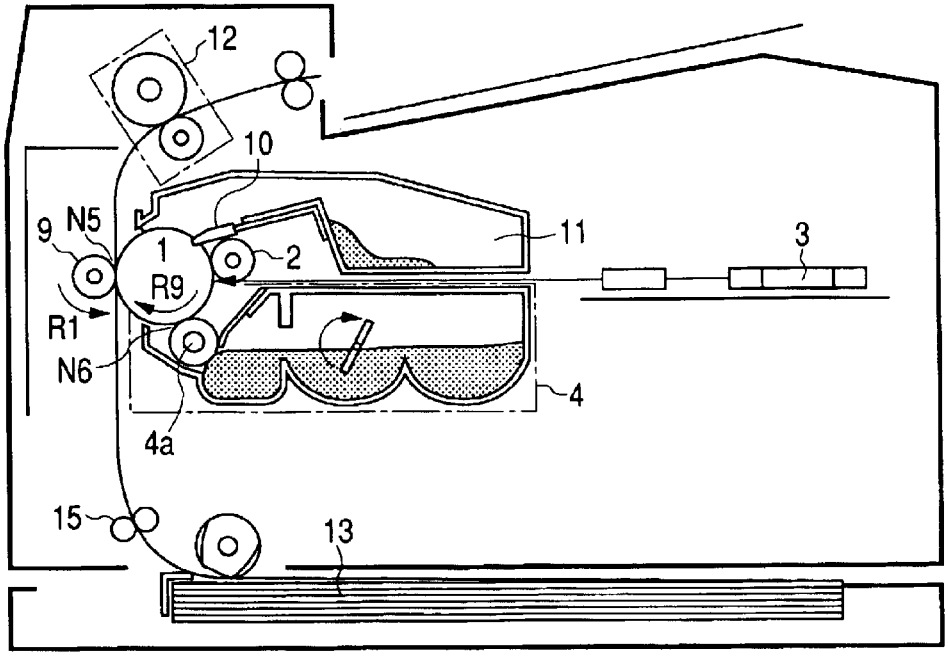
FIG. 22 shows the entire configuration of an example of the image forming apparatus.

FIG. 21 shows in a time series the change of the developing bias (voltage) to be applied to the developing roller 204*a* (204Y, 204M, 204C, and 204K) when images on two pages are continuously formed on the transferring material. FIG. 21 shows the data of the colors yellow (Y), magenta (M), cyan (C), and black (K) in order from the bottom.

First, at the timing T1, the system starts driving the photosensitive drum 201. At the timing T2, the developing bias control value V corresponding to the environment of the image forming apparatus is set based on the table shown in FIG. 12 by applying the transferring bias T to the transferring roller 209Ya from the high transferring voltage source S2, and simultaneously detecting by the transferring current detecting portion 109*b* the current value of the current flowing through the transferring roller 209Ya at the timing T3.

Then, at the timing T4, the rotation of the developing roller 204Ya is started, and the developing bias control value V in the non-image-forming area determined in the transferring value detecting operation is applied to the developing roller 204*a*. The timing T4 is different for each color, that is, a timing T4*y* is set for yellow (Y), a timing T4*m* is set for magenta (M), a timing T4*c* is set for cyan (C), and a timing T4*k* is set for black (K).

Then, at the timing T5, the developing roller 204*a* contacts the photosensitive drum 201 charged with the dark portion potential Vd by the charging roller 202*a*. The timing of attaching the developing roller 204*a* (204Ya, 204Ma, 204Cs, and 204Ka) to the photosensitive drum 201 (201Y, 201M, 201C, and 201K) is the timing T5 commonly used for each color.

At the timing T6 (T6*y*, T6*m*, T6*c*, and T6*k*) where the initial rotating operation terminates and an image forming area in which a toner image is formed reaches the position opposite the developing roller 204*a*, the developing bias is changed from the developing bias control value V to the developing bias V0 set for an image forming area. At the timing T7 (T7*y*, T7*m*, T7*c*, and T7*k*), when the portion corresponding to the interval between sheets reaches the position opposite the developing roller 204*a*, the developing bias is changed from the developing bias V0 set for the image forming area to the developing bias control value V set for the non-image-forming area.

When the image forming area for the image on the second page reaches the position opposite the developing roller 204*a*, the developing bias is changed again from the developing bias control value V set for the non-image-forming area to the developing bias V0 set for the image forming area. Then, at the timing T9 (T9*y*, T9*m*, T9*c*, and T9*k*) of the passage of the image forming area on the second page, the developing bias is changed from the voltage set for the image forming area to the developing bias control value V in the non-image-forming area. The timings T6 through T9 are different for each color, and are shown in FIG. 21.

Then, the post-rotation process (operation performed to stabilize the surface potential of the photosensitive drum 101 in preparation for the subsequent image forming operation) is started upon completion of forming images on two pages, and terminated at the timing T11 after the developing roller 204*a* is detached from the photosensitive drum 201 at the timing T10.

The fourth embodiment of the present invention is different from the third embodiment, and the transferring material conveying belt E intervenes between the photosensitive drum 201Y and the transferring roller 209Ya. Therefore, the transferring current detecting portion 109*b* detects the current flowing between the transferring roller 209Ya and the photosensitive drum 201 through the transferring material conveying belt E. Then, the occurrence of spots on the reverse of a sheet can be suppressed without accumulating the fog toner on the transferring material conveying belt E.

In the explanation above, the transferring current detecting portion 109*b* detects the transferring current value Ia for yellow (Y), and does not detect the transferring current value Ia (Ima, Ica, and Ika) of the current flowing through the transferring roller 209*a* of other colors, but the cartridges of the colors other than yellow (Y) can be provided with the respective detecting portions for detecting the transferring current values Ia in the transferring rollers 209Ma, 209Ca, and 209Ka to control the developing bias of the non-image-forming area for each color.

When the transferring current value Ia is detected only for yellow (Y), it is not necessary to provide a plurality of transferring current detecting portions, thereby obtaining the merits of reducing the cost, downsizing the power supply unit, etc.

On the other hand, since there is a case in which there are different back contrast ranges for suppressing the fog by the feature of the toner of each color, it is effective to prepare a table of developing bias in advance for the transferring current value Ia for each color.

Furthermore, the thickness information of the CT layer is stored in the ROM 120 provided in each of the cartridge 200Y of yellow (Y), the cartridge 200M of magenta (M), the cartridge 200C of cyan (C), and the cartridge 200K of black (K), and an appropriate developing bias value is set according to the transferring current value Ia and the thickness information about the CT layer for each cartridge. On the other hand, the developing bias to be applied to the developing roller 204*a* of each color can be set based on the table shown in FIG. 12 by providing the ROM 120 only for the cartridge 200Y of yellow (Y), and regarding the thickness of the CT layer of the photosensitive drum 201Y of yellow (Y) as the thickness of the CT layer in the photosensitive member 201 of another color.

With the configuration of the fourth embodiment of the present invention, in the environments of L/L, N/N, and H/H, a durability test is conducted on 10,000 sheets of full-color print corresponding to the durability of a cartridge with a good printing result without any toner spots on the reverse of the sheets as in the third embodiment.

The transferring means for the transferring bias from the reverse of the transferring material conveying belt E is not limited to the transferring roller according to the present embodiment, but can be a blade-shaped, brush-shaped, brush roller, etc. can be available.

(Fifth Embodiment)

The fifth embodiment of the present invention is described below by referring to the attached drawings.

The image forming apparatus according to the fifth embodiment of the present invention has the same configuration as the first embodiment shown in FIG. 1 cited in the third embodiment.

Therefore, the functions, operations, etc. of each portion of the image forming apparatus are the same as those explained in the first embodiment, and the detailed explanation is omitted here.

In the first embodiment of the present invention, the transferring current value Ia of the current flowing through the photosensitive drum 101 and the transferring roller 109*a* is detected, and an appropriate developing bias control value V not generating fog in the non-image-forming area is set from the table stored in advance based on the detection result.

The fifth embodiment is a variation of the first embodiment, an appropriate developing bias not generating fog in the non-image-forming area is set depending on the transferring bias T set for an image forming area in addition to the detection result of the transferring current value Ia.

As described above, the image forming apparatus shown in FIG. 1 uses a transferring roller for transferring an image from the photosensitive drum 101 to a transferring material.

A transferring roller system refers to a system in which a toner image on the photosensitive drum 101 is transferred to a transferring material by enclosing the transferring material such as a paper sheet, etc. between the photosensitive drum 101 and the transferring roller 109*a*, and applying a positive voltage from the reverse of the transferring material.

As described above in the first embodiment, whether or not ground fog or reverse fog occurs in a non-image-forming area of the photosensitive drum 101 depends on whether or not the developing bias V (back contrast) for the surface potential Vd of the photosensitive drum 101 is within a predetermined range. If the value of the back contrast is equal to or smaller than a predetermined value, the ground fog occurs. If the value of the back contrast is equal to or larger than a predetermined value, the reverse fog occurs.

That is, it is necessary to avoid the fog to set the back contrast within a predetermined value by setting an appropriate developing bias based on the surface potential Vd of the photosensitive drum 101. However, the surface potential Vd of the photosensitive drum 101 is affected by the value of the transferring bias (voltage) T set for the image forming area of the photosensitive drum 101 from the transferring roller 109*a* in a specific environment or on the image forming condition.

In detail, the transferring bias T is to be applied when the image forming area of the photosensitive drum 101 on which a toner image is formed passes the transferring roller 109*a*, and provides a positive charge for the photosensitive drum 101. The portion provided with the positive charge by the transferring roller 109*a* is assigned a negative charging bias when it passes the charging roller 102*a*. However, the charging level might not reach a desired charging potential depending on the amount of the positive charge because a positive voltage is applied to the transferring roller 109*a* in the image forming area and a positive charge is provided for the photosensitive drum 101, but the photosensitive drum 101 has the characteristic of storing a negative charge, thereby attenuating the surface potential Vd of the photosensitive drum 101 after the charging process performed by the charging roller 102*a* by the influence of the positive charge from the transferring material.

The voltage applied to the transferring roller 109*a* is determined according to the transferring current value 1*a* of the current flowing between the transferring roller 109*a* and the photosensitive drum 101 detected by the transferring current detecting portion 109*b* when a predetermined DC voltage (for example, 1000 V) is applied to the transferring roller 109*a* before the image forming operation, and the transferring material information (relating to the material of a paper sheet such as a standard sheet, a heavy sheet, a glossy sheet, an OHT sheet, etc., the size of sheet, both face print, etc.) from the host computer. FIG. 17 shows an example of the information.

FIG. 17 shows the transferring bias (voltage) T selected according to the transferring current value Ia detected by the transferring current detecting portion 109*b* and the type of transferring material (a standard sheet, a heavy sheet, a glossy sheet, an OHT sheet) and the transferring material information about the page number 2 of the both face printing sheet. Each transferring bias value shown on the table in FIG. 17 is stored in the memory, etc. not shown in the attached drawings, but provided in the image forming controller 105. The image forming controller 105 selects a transferring bias from the table based on the transferring material information input from an external device through the image process controller 106 and the detection result of the transferring current value Ia output from the transferring voltage control portion 109*c* when an image is formed, and controls the transferring voltage control portion 109*c* such that the selected transferring bias can be applied.

For example, when an image is to be formed on the reverse (second face) after the printing process is performed on the first face at an instruction from an external device to perform the both-face printing process on the transferring material of a standard sheet, and when the transferring current value Ia is 60 $\mu$A, 1600 V is selected from the transfer bias table shown in FIG. 17, and applied to the transferring roller 109*a*.

When the transferring bias T set as described above is applied to the transferring roller 109*a*, the influence of the photosensitive drum 101 on the surface potential Vd is checked. As a result, when a colored value (indicated by a bold numeric character) on the transferring bias table shown in FIG. 17 is selected, the surface potential Vd of the photosensitive drum 101 is decreased by about 30 V (−500 V→−470 V in the N/N environment).

Based on the above mentioned check result, the operation of the image forming apparatus according to the fifth embodiment is described below.

In the fifth embodiment, in addition to the table shown in FIG. 4, the table shown in FIG. 18 is stored in the memory, etc. of the image forming controller 105. The image forming controller 105 sets the developing bias control value V from the table shown in FIG. 4 when the transferring bias T applied to the transferring roller 109*a* does not correspond to the colored (indicated by a bold numeric character) portion shown in FIG. 17, and sets the developing bias control value V from the table shown in FIG. 18 when the transferring bias T applied to the transferring roller 109*a* corresponds to the colored (indicated by a bold numeric character) portion shown in FIG. 17. For example, when the transferring current value Ia is 20 $\mu$A, and the printing process is being performed on the second face (second page) of the standard sheet, 2000 V is selected as a transferring bias. However, since it also corresponds to the colored portion, −320 V is selected as a developing bias control value V from FIG. 18. The voltage is obtained by shifting the voltage of −350 V of the developing bias control value to be applied to a non-image-forming area in a normal operation 30 V toward the positive side.

Then, according to an instruction from the image forming controller 105, the charging voltage control portion 102*b* controls the developing bias (voltage) V to be applied to the developing roller 104*a* in a non-image-forming area of the photosensitive drum 101, thereby maintaining the range of the back contrast within a predetermined range.

Heretofore the setting method is described in which, when the non-image-forming area of the photosensitive drum 101 passes the developing roller 104*a*, the developing bias control value V to be applied to the developing roller 104*a* is set. The timing of applying a developing bias to the non-image-forming area of the photosensitive drum 101 has been clarified in FIG. 5 according to the first embodiment and the explanation thereof. Accordingly, the detailed explanation is omitted here.

As a result of the above mentioned process performed as described above, the back contrast can be within a predetermined range regardless of the environment fluctuation, the fluctuation of the thickness of the CT layer of the photosensitive drum, and the size of the transferring bias, thereby avoiding or reducing the occurrence of the fog in a non-image-forming area, and preventing the toner of the fog from being accumulated on the transferring roller or causing spots on the reverse of the sheet.

With the configuration according to the fifth embodiment, in the environments of L/L, N/N, and H/H, a durability test is conducted on 10,000 sheets corresponding to the durability of a cartridge using various types of transferring materials with a good printing result without any toner spots on the reverse of the sheets.

In the fifth embodiment, the thickness of the CT layer is not taken into account, but, as in the third embodiment, the thickness information about the CT layer can be stored in the memory, etc. provided in the cartridge configured as detachably attachable to the image forming apparatus with the developing device, the charging unit, the photosensitive drum, etc. integrated as a unit, and a plurality of "conversion tables from the transferring current value Ia corresponding to the thickness of the CT layer to the developing bias control value V" can be prepared.

In this case, in the image forming operation, the image forming controller 105 refers to the thickness of the CT layer stored in the memory, and sets the developing bias control value using the conversion table corresponding to the thickness of the CT layer.

For example, the conversion table shown in FIG. 24 is used in addition to the conversion table shown in FIG. 12. The portions other than the colored portions (indicated by bold numeric characters) in FIG. 17 are based on FIG. 12, and the colored portions (indicated by bold numeric characters) in FIG. 17 are based on FIG. 24, thereby maintaining the back contrast within a predetermined range.

In the fifth embodiment, a transferring roller is used as transferring means, but a transferring brush, a transferring brush roll, etc. can also be used.

The initial value of each voltage value, etc. in the fifth embodiment is not limited to the specified value, but can be appropriately selected if the effect of the present invention can be obtained.

Since the influence of the transferring bias T on the surface potential Vd of the photosensitive drum appears only after the transfer of a toner image, the developing bias determined based on only the transferring current value Ia according to the table shown in FIG. 4 is applied, for example, during the initial rotation (from the timing T4 to the timing T6) shown in FIG. 5, and the developing bias can be applied with the transferring bias according to the table shown in FIGS. 4 and 18 taken into account between the sheets after transferring the toner image (from the timing T7 to the timing T8) or during the post-rotation.

Furthermore, when the transferring bias is changed by changing the type of transferring material during the continuous printing process, and when the transferring bias is changed by changing the resistance of the sheets due to the passage of a fixing unit on the front or back face in the both-face printing process, etc., the developing bias on the interval between sheets immediately after changing the transferring bias or during the post-rotation can be changed into an appropriate value according to the tables shown in FIGS. 4 and 18.

(Sixth Embodiment)

The sixth embodiment of the present invention is described below by referring to the attached drawings.

The sixth embodiment is an application of the fifth embodiment to the full-color image forming apparatus. Depending on the transferring bias T set for an image forming area in addition to the detection result of a transferring current value Ia, an appropriate developing bias which does not generate the fog in a non-image-forming area is set.

The full-color image forming apparatus according to the sixth embodiment has the configuration similar to that shown in FIG. 9 according to the second embodiment.

Therefore, since the functions, operations, etc. of each portion of the image forming apparatus are similar to those explained by referring to the second embodiment, the explanation is omitted here.

Described below is the operation of the sixth embodiment.

The transferring bias T is determined according to the table shown in FIG. 17 based on the transferring current value Ia and the transferring material information (relating to the material of a paper sheet such as a standard sheet, a heavy sheet, a glossy sheet, an OHT sheet, etc., the size of sheet, both face print, etc.) from the host computer. Each transferring bias value according to the table shown in FIG. 17 is stored in the memory, etc. not shown in the attached drawings, but provided in the image forming controller 105. When an image is formed, the image forming controller 105 selects a transferring bias from the table based on the transferring material information input from an external device through the image process controller 106 and the detection result of the transferring current value Ia output from the transferring voltage control portion 109*c*, and controls the transferring voltage control portion 109*c* such that the selected transferring bias can be applied.

For example, if an instruction to perform a both-face printing process is issued from an external device to the transferring material of standard sheet, and an image is to be formed on the reverse (second page) after the front page is printed, and when the transferring current value Ia is 60 $\mu$A, then 1600 V is selected from the transferring bias table and applied to the transferring roller 109*a*.

If the transferring bias T applied to the transferring roller 209Ya does not correspond to the colored portions (indicated by bold numeric characters) shown in FIG. 17, the image forming controller 105 sets the developing bias control value V according to the table shown in FIG. 12. If the transferring bias T applied to the transferring roller 209Ya corresponds to the colored portions (indicated by bold numeric characters) shown in FIG. 17, the image forming controller 105 sets the developing bias control value V according to the table shown in FIG. 18. For example, when the transferring current value Ia is 20 $\mu$A, and standard second page (second page) is to be printed, 2000 V is selected as a transfer bias. Additionally, since it corresponds to the colored portion, −320 V is selected as a developing bias control value from FIG. 18. It is a voltage shifted 30 V toward the positive side from −350 V of the developing bias control value to be applied to a non-image-forming area during the normal operation.

At an instruction from the image forming controller 105, the charging voltage control portion 102*b* controls the developing bias (voltage) V to be applied to the developing roller 204Ya in the non-image-forming area of the photosensitive drum 101, thereby maintaining the back contrast within a predetermined range.

The method of setting the developing bias control value V to be applied to the developing roller 204Ya when the non-image-forming area of the photosensitive drum 201Y passes the developing roller 204Ya is described above, but the timing of applying the developing bias set for the non-image-forming area of the photosensitive drum 201Y has been clarified by referring to FIG. 5 according to the first embodiment. Therefore, the explanation is omitted here.

The sixth embodiment of the present invention is different from the fifth embodiment, and the transferring material conveying belt E intervenes between the photosensitive drum 201Y and the transferring roller 209Ya. Therefore, the transferring current detecting portion 109*b* detects the current flowing between the transferring roller 209Ya and the photosensitive drum 201 through the transferring material conveying belt E. Then, the occurrence of spots on the reverse of a sheet can be suppressed without accumulating the fog toner on the transferring material conveying belt E.

In the sixth embodiment, the thickness of the CT layer is not taken into account, but, as in the fourth embodiment, the thickness information about the CT layer can be stored in the memory, etc. provided in the cartridge configured as detachably attachable to the image forming apparatus with the developing device, the charging unit, the photosensitive drum, etc. integrated as a unit, and a plurality of "conversion tables from the transferring current value Ia corresponding to the thickness of the CT layer to the developing bias control value V" can be prepared.

In this case, in the image forming operation, the image forming controller 105 refers to the thickness of the CT layer stored in the memory, and sets the developing bias control value using the conversion table corresponding to the thickness of the CT layer.

For example, the conversion table shown in FIG. 24 is used in addition to the conversion table shown in FIG. 12. The portions other than the colored portions (indicated by bold numeric characters) in FIG. 17 are based on FIG. 12, and the colored portions (indicated by bold numeric characters) in FIG. 17 are based on FIG. 24, thereby maintaining the back contrast within a predetermined range.

In the explanation above, the cartridge 200Y of yellow (Y) is described, and the transferring current detecting portion 109*b* detects the transferring current value Ia for yellow (Y). However, the cartridges for the colors other than yellow (Y) are provided with detecting portions for detecting the transferring current value Ia in each of the transferring rollers 209Ma, 209Ca, and 209Ka as the cartridge for yellow (Y) so that the developing bias for the non-image-forming area can be controlled for each color, or the transferring current value Ia can be detected only for yellow (Y) and the developing bias for the non-image-forming area can be controlled for other colors (magenta (M), cyan (C), and black (K)) based on the detection result on yellow (Y).

In the former, when the transferring current value Ia is detected only for yellow (Y), it is not necessary to provide a plurality of transferring current detecting portions, thereby obtaining the merits of reducing the cost, downsizing the power supply unit, etc.

In the latter, since there is a case in which there are different back contrast ranges for suppressing the fog by the feature of the toner of each color, it is effective to prepare a table of developing bias in advance for the transferring current value Ia for each color.

When the transferring bias T to be applied to each photosensitive drum is sequentially changed with the change of the drums from the upper photosensitive drum 201Y to the photosensitive drum 201M, the photosensitive drum 201C, and the photosensitive drum 201K, each of developing biases can be advantageously controlled.

For example, FIG. 19 shows the type of transferring material for the transferring current value Ia, the print mode, and the transferring bias control value for each cartridge. In this case, the developing bias control value in the non-image-forming area can be controlled to be shifted 30 V toward the positive side according to the table shown in FIG. 18 for the colored portion (indicated by a bold numeric character).

Furthermore, in the sixth embodiment, the influence of the transferring bias T in the image forming area of the photosensitive drum is determined according to the transferring material information such as the transferring current value Ia, the type of transferring material, the print mode (first or second page in the both-face printing process), etc., and by each cartridge. Otherwise, one or a plurality of, or a value obtained by conversion by an expression of plural items of the transferring bias T in the image forming area of the photosensitive drum, the type of transferring material, the size of transferring material, the resistance value of transferring material (measuring means can be provided, or resistance value information can be stored in the image forming apparatus), the conveying speed of transferring material, the resistance value of transferring material, the environmental temperature and humidity of the image forming apparatus, the transferring material use history (for example, after or before the both-face printing process), etc. can be appropriately selected.

Since there is a case in which there are different back contrast ranges for suppressing the fog by the feature of the toner of each color, it is effective to prepare a table of developing bias in advance for the transferring current value Ia for each color.

The transferring means for the transferring bias from the reverse of the transferring material conveying belt E is not limited to the transferring roller according to the present embodiment, but can be a blade-shaped, brush-shaped, brush roller, etc. can be available.

(Seventh Embodiment)

The seventh embodiment of the present invention is described below by referring to the attached drawings.

Since the configuration and the image forming operations according to the seventh embodiment are similar to those according to the second embodiment of the present invention, the explanation is omitted here.

The seventh embodiment of the present invention is a variation of the sixth embodiment. Each cartridge is provided with nonvolatile memory storing the information about the use of the photosensitive drum. According to the information, the amendment amount (shift amount) of the developing bias in the non-image-forming area can be set.

As described above in the sixth embodiment, the surface potential Vd of the photosensitive drum is attenuated by the transferring bias T applied to the image forming area. The attenuation amount possibly depends on the thickness of the CT layer of the photosensitive drum. In the seventh embodiment, the influence of the transferring bias is considerable, that is, about a 50 V reduction occurs when the thickness of the CT layer is smaller than 11 $\mu$m.

Therefore, in the seventh embodiment, the amendment amount (shift amount) of the developing bias is set by the thickness of the CT layer of the photosensitive drum in addition to the control of the developing bias according to the sixth embodiment. The practical method is described below.

When the cartridges 204Y, 204M, 204C, and 204K respectively including the photosensitive drums 201Y, 201M, 201C, and 201K are inserted into the apparatus body B, the apparatus body B reads the use information (thickness information about the CT layer) of the photosensitive drums 201Y, 201M, 201C, and 201K stored in the plural units of ROM 120 (120Y, 120M, 120C, and 120K) mounted respectively in the cartridges 204Y, 204M, 204C, and 204K.

In the seventh embodiment, the plural units of ROM 120 (120Y, 120M, 120C, and 120K) mounted respectively in the cartridges 204Y, 204M, 204C, and 204K store the rotation time T1, the charging bias applying time T2, and the developing roller rotation time T3 of the photosensitive drums 201Y, 201M, 201C, and 201K. The thickness y of the CT layer of the photosensitive drums 201Y, 201M, 201C, and 201K can be obtained as a coefficient assigned predetermined values of a, b, and c by the following equation.

$$\gamma=(\text{initial thickness})-(\alpha\times T1+b\times T2+c\times T3)$$

When the thickness of the photosensitive layer $\alpha$ is 11 $\mu$m or less, the developing bias control value of a non-image-forming area used in the sixth embodiment is further shifted 20 V toward the positive side. In detail, the value obtained by 20 V shifting each developing bias control value shown in FIG. 18 toward the positive side is set as a developing bias.

When the thickness of the photosensitive layer is 11 $\mu$m or more, then the value shown in FIG. 18 is set as a developing bias.

Thus, the current Ia flowing between the transferring roller 209 and the photosensitive drum 201 through the transferring material conveying belt E in each cartridge is measured, and the developing bias set for the non-image-forming area (non-sheet-passing portion) of the photosensitive drum is controlled according to the table similar to that shown in FIG. 4, the transferring bias table shown in FIG. 17 or 19, and the use information (thickness information about the CT layer) about the photosensitive drum stored in the ROM 120 of each cartridge, thereby preventing the occurrence of spots on the reverse without accumulating the fog toner on the transferring material conveying belt E.

With the configuration of the seventh embodiment of the present invention, in the environments of L/L, N/N, and H/H, a durability test is conducted on 10,000 sheets of full-color print corresponding to the durability of a cartridge with a good printing result without any toner spots on the reverse of the sheets as in the sixth embodiment.

The transfer detection current to be measured can be individually measured for each cartridge, but a specified cartridge can be measured, and the result can be applied to other cartridges as in the sixth embodiment.

The photosensitive member use information for measurement of the thickness of the CT layer of the photosensitive drum can be one or a plurality of, or a value obtained by conversion by an expression of plural items of the rotation time of the photosensitive drum according to the seventh embodiment, the charging bias applying time, the developing roller rotation time, the number of rotation of the photosensitive drum, the time of the photosensitive member operating the cleaning member (when attached, detached, etc.), the transferring bias T applying time, the residual thickness of the photosensitive member of the image bearer, the used thickness, etc. Furthermore, the residual thickness of the photosensitive member computed according to each piece of information, or the used thickness itself can be stored in the memory. Additionally, when the photosensitive drum is not removed until the termination of the process, the use information about the photosensitive drum can be stored in the image forming apparatus to be used.

The present invention is not limited to the above mentioned embodiments, and variations can be available within the scope of the claims of the invention.

What is claimed is:

1. An image forming apparatus, comprising:

an image bearer for bearing an image formed on a transferring material;

a charging portion for charging said image bearer with predetermined potential;

an exposing portion for forming an electronic latent image by exposing an image forming area of said image bearer charged with the predetermined potential;

a developing portion for developing an electronic latent image on said image bearer to form on said image bearer an image to be formed on the transferring material, wherein a voltage set in said developing portion for the image forming area of said image bearer is different from a voltage set in said developing portion for a non-image-forming area of said image bearer;

a transferring portion for transferring an image formed on said image bearer by said developing portion to the transferring material;

a transferring current detecting portion for detecting a transferring current flowing through said transferring portion; and a controlling portion for controlling a voltage set in said developing portion, wherein a voltage set in said developing portion for the non-image-forming area of said image bearer is controlled based on a transferring current value detected by said transferring current detecting portion.

2. The image forming apparatus according to claim 1, wherein said controlling portion drops a voltage set in said developing portion for the non-image-forming area of said image bearer as the transferring current value detected by said transferring current detecting portion increases.

3. The image forming apparatus according to claim 1, wherein the non-image-forming area is an area on an image bearer passing said developing portion when an image is continuously formed on a plurality of transferring materials, and corresponds to conveying intervals of the plurality of transferring materials.

4. The image forming apparatus according to claim 1, wherein the non-image-forming area is an area on an image bearer passing said developing portion when said image bearer is rotated to start forming an image and said charging portion charges the surface of said image bearer with a predetermined potential.

5. The image forming apparatus according to claim 1, wherein the non-image-forming area is an area on an image bearer passing said developing portion when said image bearer is rotated to stop forming an image and said charging portion charges the surface of said image bearer with a predetermined potential.

6. The image forming apparatus according to claim 1, further comprising:

a storage portion for storing use history information about said image bearer, wherein said controlling portion controls a voltage set in said developing portion for a non-image-forming area of said image bearer based on a transferring current value detected by said transferring current detecting portion and use history information about said image bearer stored in said storage portion.

7. The image forming apparatus according to claim 6, wherein the use history information relates to a rotation time from a start of using said image bearer.

8. The image forming apparatus according to claim 6, wherein the use history information relates to an operation time of said charging portion from a start of using said image bearer.

9. The image forming apparatus according to claim 1, further comprising:

a determining portion for determining a type of transferring material; and a transfer voltage control portion for controlling a voltage to be applied to said transferring portion, wherein:

the voltage to be applied to said transferring portion is controlled depending on the type of transferring material determined by said determining portion; and said controlling portion controls the voltage set in said developing portion for the non-image-forming area of said image bearer depending on the type of transferring material determined by said determining portion.

10. The image forming apparatus according to claim 1, wherein said controlling portion maintains a constant difference between potential in an exposed area exposed by said exposing portion in an image forming area of said image bearer and a voltage set in said developing portion for the image forming area of said image bearer regardless of the transferring current value.

11. An image forming apparatus, comprising:

a plurality of image bearers for bearing an image formed on a transferring material;

a plurality of charging portions, provided for each of said plurality of image bearers, for charging said image bearers with predetermined potential;

a plurality of exposing portions, provided for each of said plurality of image bearers, for forming an electronic latent image by exposing image forming areas of said image bearers charged with predetermined potential;

a plurality of developing portions, provided for each of said plurality of image bearers, for developing the electronic latent image on said image bearers to form on said image bearers an image to be formed on the transferring material, wherein a voltage set in said developing portion for the image forming area of said image bearer is different from a voltage set in said developing portion for a non-image-forming area of said image bearer;

a plurality of transferring portions, provided for each of said plurality of image bearers, for transferring the image formed on said image bearers by said developing portion to the transferring material;

a transferring current detecting portion, provided in at least one of said plurality of transferring portion, for detecting a transferring current flowing through said transferring portion; and a controlling portion for controlling a voltage set in said developing portion, wherein a voltage set in said developing portion for the non-image-forming area of said image bearer is controlled based on a transferring current value detected by said transferring current detecting portion.

12. The image forming apparatus according to claim 11, wherein:

said transferring current detecting portion is provided in one of said plurality of transferring portions; and said controlling portion controls a voltage set in said developing portion for the non-image-forming area of said image bearers based on the transferring current value.

13. The image forming apparatus according to claim 11, wherein:

said transferring current detecting portion is provided for each of said plurality of transferring portions; and said controlling portion controls a voltage set for the non-image-forming area of said image bearers for each of said plurality of developing portions based on said plurality of the transferring current value.

14. The image forming apparatus according to claim 11, wherein said controlling portion drops a voltage set for the non-image-forming area of said image bearer as the transferring current value detected by said transferring current detecting portion increases.

15. The image forming apparatus according to claim 11, wherein the non-image-forming area is an area on an image bearer passing said developing portion when an image is continuously formed on a plurality of transferring materials, and corresponds to conveying intervals of the plurality of transferring materials.

16. The image forming apparatus according to claim 11, wherein the non-image-forming area is an area on an image bearer passing said developing portion when said image bearer is rotated to start forming an image and said charging portion charges the surface of said image bearer with a predetermined potential.

17. The image forming apparatus according to claim 11, wherein the non-image-forming area is an area on an image bearer passing said developing portion when said image bearer is rotated to stop forming an image and said charging portion charges the surface of said image bearer with a predetermined potential.

18. The image forming apparatus according to claim 11, further comprising a plurality of storage portions, provided for each of said plurality of image bearers, for storing use history information of said image bearers, wherein said controlling portion controls a voltage set in said developing portion for a non-image-forming area of said image bearer based on a transferring current value detected by said transferring current detecting portion and use history information about said image bearer stored in said storage portion.

19. The image forming apparatus according to claim 18, wherein the use history information relates to a rotation time from a start of using said image bearer.

20. The image forming apparatus according to claim 18, wherein the use history information relates to an operation time of said charging portion from a start of using said image bearer.

21. The image forming apparatus according to claim 11, further comprising:

a determining portion for determining a type of transferring material; and a transferring voltage controlling portion for controlling a voltage to be applied to each of the plurality of transferring portions, wherein:

the voltage to be applied to said transferring portion is controlled depending on the type of transferring material determined by said determining portion; and said controlling portion controls the voltage set in said developing portion for the non-image-forming area of said image bearer depending on the type of transferring material determined by said determining portion.

22. The image forming apparatus according to claim 11, wherein said controlling portion maintains a constant difference between potential in an exposed area exposed by said exposing portion in an image forming area of said image bearer and a voltage set in said developing portion for the image forming area of said image bearer regardless of the transferring current value.

* * * * *

UNITED STATES PATENT AND TRADEMARK OFFICE

CERTIFICATE OF CORRECTION

PATENT NO. : 6,785,482 B2
DATED : August 31, 2004
INVENTOR(S) : Hiroaki Ogata et al.

It is certified that error appears in the above-identified patent and that said Letters Patent is hereby corrected as shown below:

Title page,
Item [56], References Cited, U.S. PATENT DOCUMENTS, "06194901 A" should read -- 6-194901 -- ; and "2001100469 A" should read -- 2001-100469 A --.

Column 3,
Line 33, "in a" should read -- a --.

Column 4,
Line 30, "in a" should read -- a --.

Column 14,
Line 24,"a" should be deleted.

Column 17,
Line 9, "(∏)" should read -- (▲) --; and
Line 34, should be deleted.

Column 27,
Line 3, "can be available." should be deleted.

Signed and Sealed this

Eighth Day of February, 2005

JON W. DUDAS
*Director of the United States Patent and Trademark Office*